United States Patent [19]

Yamada et al.

[11] 4,189,972

[45] Feb. 26, 1980

[54] ELECTRONIC MUSICAL INSTRUMENT OF NUMERICAL VALUE PROCESSING TYPE

[75] Inventors: Shigeru Yamada; Kiyoshi Ichikawa, both of Hamamatsu, Japan

[73] Assignee: Nippon Gakki Seizo Kabushiki Kaisha, Hamamatsu, Japan

[21] Appl. No.: 880,203

[22] Filed: Feb. 22, 1978

[30] Foreign Application Priority Data

Feb. 26, 1977 [JP] Japan ..... 52-20443

[51] Int. Cl.[2] ..... G10H 1/04; G10H 5/00

[52] U.S. Cl. ..... 84/1.25

[58] Field of Search ..... 84/1.13, 1.24–1.26, 84/DIG. 4

[56] References Cited

U.S. PATENT DOCUMENTS

| | | | |
|---|---|---|---|
| 3,951,030 | 4/1976 | Deutsch | 84/1.25 |
| 3,952,623 | 4/1976 | Deutsch | 84/1.24 |
| 4,026,180 | 5/1977 | Tomisawa et al. | 84/1.25 |
| 4,083,284 | 4/1978 | Nakada | 84/1.25 |
| 4,086,838 | 5/1978 | Kawamura | 84/1.25 |

*Primary Examiner*—S. J. Witkowski
*Attorney, Agent, or Firm*—Charles E. Pfund

[57] ABSTRACT

In an electronic musical instrument of a numerical value processing type, an operation of a key causes the generation of a numerical value corresponding to the operated key and a tone having a frequency determined by the numerical value is produced. A vibrato effect is obtained by periodic modification of the value. The instrument comprises a circuit which generates a periodic signal having a portion in which the amplitude of the periodic signal increases at a predetermined rate, and a succeeding portion having a constant amplitude, and a circuit for varying the rate. The rate varying circuit sets the rate to be either a low rate that can be discriminated by human ears or a high rate that can not be discriminated by human ears.

3 Claims, 15 Drawing Figures

| | STEP | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 |
|---|---|---|---|---|---|---|---|---|---|---|---|---|---|---|---|---|---|---|---|---|---|---|---|---|---|---|---|---|---|---|---|---|---|
| (a) | LOWER BIT | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 | 0 | 1 |
| | | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 |
| | | 0 | 0 | 0 | 0 | 1 | 1 | 1 | 1 | 0 | 0 | 0 | 0 | 1 | 1 | 1 | 1 | 0 | 0 | 0 | 0 | 1 | 1 | 1 | 1 | 0 | 0 | 0 | 0 | 1 | 1 | 1 | 1 |
| | | 0 | 0 | 0 | 0 | 0 | 0 | 0 | 0 | 1 | 1 | 1 | 1 | 1 | 1 | 1 | 1 | 0 | 0 | 0 | 0 | 0 | 0 | 0 | 0 | 1 | 1 | 1 | 1 | 1 | 1 | 1 | 1 |
| | UPPER BIT | 0 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | 1 | 1 |
| (b) | LOWER BIT | 0 | 1 | 0 | 1 | 0 | 1 | 0 | 1 | 1 | 0 | 1 | 0 | 1 | 0 | 1 | 0 | 1 | 0 | 1 | 0 | 1 | 0 | 1 | 0 | 0 | 1 | 0 | 1 | 0 | 1 | 0 | 1 |
| | | 0 | 0 | 1 | 1 | 0 | 0 | 1 | 1 | 1 | 1 | 0 | 0 | 1 | 1 | 0 | 0 | 1 | 1 | 0 | 0 | 1 | 1 | 0 | 0 | 0 | 0 | 1 | 1 | 0 | 0 | 1 | 1 |
| | | 0 | 0 | 0 | 0 | 1 | 1 | 1 | 1 | 1 | 1 | 1 | 1 | 0 | 0 | 0 | 0 | 1 | 1 | 1 | 1 | 0 | 0 | 0 | 0 | 0 | 0 | 0 | 0 | 1 | 1 | 1 | 1 |
| | | 0 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | 1 | 1 |
| | UPPER BIT | 0 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 1 | 1 | 1 | 1 | 1 | 1 |
| (c) | LOWER BIT | 1 | 0 | 1 | 0 | 1 | 0 | 1 | 0 | 0 | 1 | 0 | 1 | 0 | 1 | 0 | 1 | 0 | 1 | 0 | 1 | 0 | 1 | 0 | 1 | 1 | 0 | 1 | 0 | 1 | 0 | 1 | 0 |
| | | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 | 1 | 0 | 0 | 1 |
| | | 0 | 1 | 1 | 1 | 1 | 0 | 0 | 0 | 0 | 0 | 0 | 1 | 1 | 1 | 1 | 0 | 0 | 0 | 0 | 1 | 1 | 1 | 1 | 0 | 0 | 1 | 1 | 1 | 1 | 0 | 0 | 0 |
| | | 0 | 0 | 0 | 0 | 0 | 1 | 1 | 1 | 1 | 1 | 1 | 0 | 0 | 0 | 0 | 0 | 0 | 0 | 0 | 1 | 1 | 1 | 1 | 1 | 1 | 1 | 1 | 1 | 1 | 0 | 0 | 0 |
| | UPPER BIT | 0 | 0 | 0 | 0 | 0 | 0 | 0 | 0 | 0 | 0 | 0 | 0 | 0 | 0 | 0 | 0 | 0 | 0 | 0 | 1 | 1 | 1 | 1 | 1 | 1 | 1 | 1 | 1 | 1 | 0 | 0 | 0 |

(d)

ELECTRONIC MUSICAL INSTRUMENT OF NUMERICAL VALUE PROCESSING TYPE

BACKGROUND OF THE INVENTION

This invention relates to an electronic musical instrument of a numerical value processing type incorporated with a vibrato effect.

A vibrato effect is a performance effect produced by slightly increasing or decreasing the pitch of a musical tone having produced about seven times per second thereby obtaining sweet and confortable musical tones. The vibrato effects can be classified into a normal vibrato effect and a delay vibrato effect. The normal vibrato effect provides a vibrato effect of a definite magnitude concurrently with the commencement of the musical tone whereas according to the delay vibrato effect, the vibrato effect is increased to a maximum extent as the time elapses from the commencement to the musical tone. In the performance of such musical instruments as violines and flutes, this delay vibrato effect is used advantageously.

Since the normal vibrato effect and the delay vibrato effect enrich the musical tone use of them is highly desirable also in electronic musical instruments. For this reason, electronic musical instruments have been proposed capable of manifesting the normal and delay vibrato effects.

In the prior art electronic musical instrument, for the purpose of manifesting both of the normal and delay vibrato effects independent vibrato control circuits are provided so that not only the construction of the circuit is complicated and expensive, but also their operations are troublesome.

SUMMARY OF THE INVENTION

Accordingly, it is an object of this invention to provide an improved electronic musical instrument capable of selectively producing a vibrato control signal for providing a normal vibrato effect and a delay vibrato control signal for providing a delay vibrato effect from a common vibrato control signal.

Another object of this invention is to provide a novel electronic musical instrument including a vibrato control circuit having a simple construction yet can produce both of a normal vibrato control signal and a delay vibrato control signal.

According to this invention, there is provided an electronic musical instrument comprising a plurality of keys, a first circuit for generating a numerical value corresponding to a frequency related to an operated key, a second circuit for modifying the numerical value to produce a modified signal, a third circuit for generating a musical tone having a frequency corresponding to the modified signal, a fourth circuit which generates a modification coefficient of the numerical value in response to an operated key, and means for supplying the modification coefficient to the second circuit to modify the numerical value, said fourth circuit including means responsive to the key operation for generating a periodic signal, said circuit means having a circuit for generating the periodic signal including a portion in which the amplitude of the periodic signal increases at a predetermined rate and a succeeding portion in which the amplitude is constant, and means for varying the rate, said rate varying means including means for generating a low rate that can be discriminated by human ears, means for generating a high rate that can not be discriminated by human ears, and means for switching said rates.

BRIEF DESCRIPTION OF THE DRAWINGS

The other objects and advantages as well as the organization of the invention can be more fully understood from the following detailed description taken in conjunction with the accompanying drawings in which.

DESCRIPTION OF THE PREFERRED EMBODIMENTS

Figure 1:
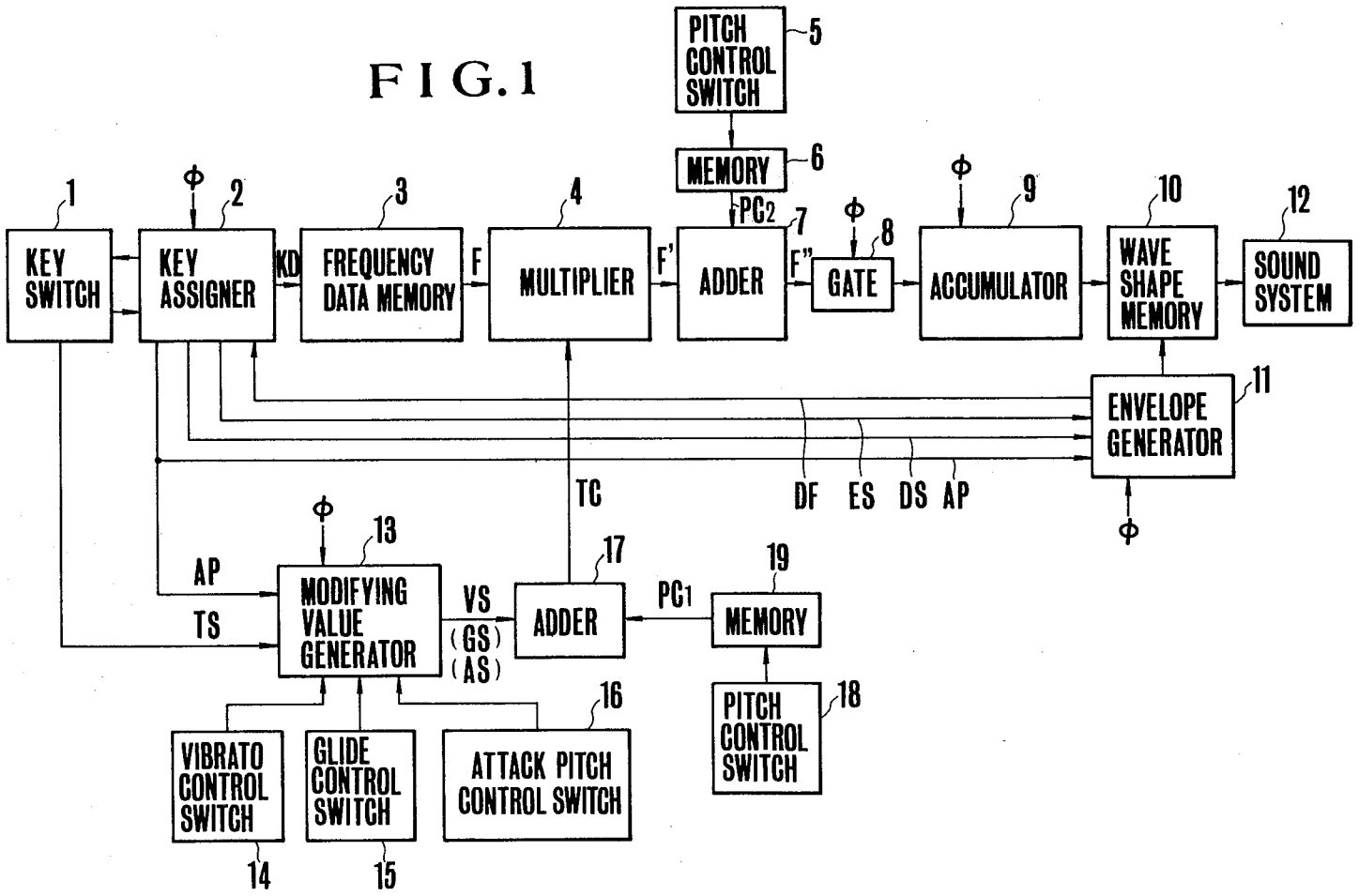
FIG. 1 is a block diagram showing the whole construction of one embodiment of the electronic musical instrument of this invention.

A preferred embodiment of the electronic musical instrument of this invention shown in FIG. 1 comprises a key switch circuit 1 provided for a keyboard, not shown, a key assigner 2, a frequency data memory device 3, a multiplier 4, a constant-Hertz pitch control switch 5, a memory device 6, an adder 7, a gate circuit 8, an accumulator 9, a waveshape memory device 10, an envelope generator 11, a sound system 12, a modifying value generator 13, a vibrato control switch 14, a glide control switch 15, an attack pitch control switch 16, an adder 17, a constantcent pitch control switch 18 and a memory device 19 which are connected as shown and constructed to operate as will be described later in more detail.

The key assigner 2 operates to detect the ON and OFF operations of the key switch 1 of respective keys of the keyboard in accordance with a sequential scanning caused by a clock pulse having a frequency of $f_0$ and supplied from a clock pulse generator, not shown, so as to assign an information utilized to identify a depressed key to either one of the channels in a number defining the number of maximum available tones to be generated simultaneously, for example 12 tones. The key assigner 2 stores key data KD representing the depressed keys in memory positions identifying the channels and sequentially produces, on the time sharing basis, the key data KD stored in the respective channels. Accordingly, when a plurality of keys of the keyboard are depressed simultaneously, depressed keys are respectively assigned to separate channels and the key data representing the assigned keys are stored in the memory positions defining respective channels. The memory positions may be constituted by the respective stages of a circulating type shift register. For example, a given key data KD identifying a specific key of the keyboard is constituted by a nine-bit code consisting of two bits $K_2$ and $K_1$ representing the kind of the keyboard, three bits $B_3$, $B_2$ and $B_1$ representing the octave range, and four bits $N_4$, $N_3$, $N_2$, $N_1$ representing the note names in one octave, as shown in the following Table 1. Where the total number of the channels is twelve, it is advantageous to use a 12-stage shift register, in which each stage comprises 9 bits.

Table 1

| key | | key data $K_2$ | $K_1$ | $B_{3'}$ | $B_{2'}$ | $B_1$ | $N_4$ | $N_{3'}$ | $N_{2'}$ | $N_1$ |
|---|---|---|---|---|---|---|---|---|---|---|
| Key board | upper | 0 | 1 | | | | | | | |
| | lower | 1 | 0 | | | | | | | |
| | pedal | 1 | 1 | | | | | | | |
| octave range | 1 | | | 0 | 0 | 0 | | | | |
| | 2 | | | 0 | 0 | 1 | | | | |
| | 3 | | | 0 | 1 | 0 | | | | |
| | 4 | | | 0 | 1 | 1 | | | | |
| | 5 | | | 1 | 0 | 0 | | | | |
| | 6 | | | 1 | 0 | 1 | | | | |
| note name | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

Consequently, the key data KD (that is the key data stored in the shift register) are sequentially produced in the time sharing basis from the key assigner 2 in coincidence with the assigned channel times. Furthermore, the key assigner 2 produces, on the time sharing basis, envelope start signals ES representing that the channels assigned to depressed keys should produce tones, in synchronism with respective channel times. Furthermore, the key assigner 2 produces decay start signals DS representing the fact that keys assigned to respective channels have been released so that the generated tones commence to attenuate, on the time sharing basis and in synchronism with respective channel times. An attack pulse AP having a pulse width equal to one slot time is generated in synchronism with the building of the envelope start signal ES. Signals ES, DS and AP are utilized by an envelope generator 11 for controlling the amplitude envelope (tone keying of the musical tone). A decay termination signal DF representing the fact that the generation of a tone in a given channel has terminated (decay termination) is applied to the key assigner 2 from the envelope generator 11 for clearing various memories regarding that channel so as to establish a waiting state for the keys subsequently depressed. In response to a key data KD supplied from the key assigner 2, the frequency data memory device 3 produces corresponding frequency data, as shown in the following Table 2, for example. In the case shown in Table 2, each data stored in the frequency data memory device 3 comprises 15 bits of which one bit is expressed as an integer part and the remaining 14 bits as fraction parts. The F values in Table 2 are decimal values converted from binary values.

Table 2

| note | integer part 15 | fraction part 14 | 13 | 12 | 11 | 10 | 9 | 8 | 7 | 6 | 5 | 4 | 3 | 2 | 1 | F value in decimal |
|---|---|---|---|---|---|---|---|---|---|---|---|---|---|---|---|---|
| $C_2$ | 0 | 0 | 0 | 0 | 0 | 1 | 1 | 0 | 1 | 0 | 1 | 1 | 0 | 0 | 1 | 0.052325 |
| $C_3$ | 0 | 0 | 0 | 0 | 1 | 1 | 0 | 1 | 0 | 1 | 1 | 0 | 0 | 1 | 0 | 0.104650 |
| $C_4$ | 0 | 0 | 0 | 1 | 1 | 0 | 1 | 0 | 1 | 1 | 0 | 0 | 1 | 0 | 1 | 0.209300 |
| $C_5$ | 0 | 1 | 1 | 0 | 1 | 0 | 1 | 1 | 0 | 0 | 1 | 0 | 1 | 0 | 0 | 0.418600 |
| $C_6$ | 0 | 1 | 1 | 0 | 1 | 0 | 1 | 1 | 0 | 0 | 1 | 0 | 1 | 0 | 0 | 0.837200 |
| $D_6$# | 0 | 1 | 1 | 1 | 1 | 1 | 1 | 1 | 0 | 1 | 1 | 1 | 0 | 0 | 0 | 0.995600 |
| $E_6$ | 1 | 0 | 0 | 0 | 0 | 1 | 1 | 1 | 0 | 0 | 0 | 0 | 0 | 0 | 1 | 1.054808 |
| $C_7$ | 1 | 1 | 0 | 1 | 0 | 1 | 1 | 0 | 0 | 1 | 0 | 1 | 0 | 0 | 1 | 1.674400 |

When supplied with an attack pulse AP from the key assigner 2, a modifying value generator 13 selectively generates a vibrato control signal VS which periodically varies up and down about the value [1] of the decimal integer, or a glide control signal GS or an attack pitch control signal AS which gradually increase from a value a predetermined amount smaller than decimal [1]. As shown, the modifying value generator 13 is provided with a vibrato control switch 14, a glide control switch 15 and an attack pitch control switch 16. By the selective setting of the vibrato control switch 14, selection of a delay vibrato, setting of the delay time and setting of the depth of the delay vibrato are effected. The selection of the normal vibrato and the setting of the depth thereof are also made. Furthermore, the selection of a touch vibrato which varies the pitch in accordance with a key touch signal TS supplied from the key switch 1 and corresponding to left and right movement of the fingers on the keys, and the setting of the depth of the touch vibrato are also made. While the glide control switch 15 (for example, a foot switch which is closed when a foot pedal is moved laterally) is being closed a glide effect is selected in which the pitch of all generated tones is lowered by a predetermined amount and then gradually increased to the standard pitch after the glide control switch 5 is opened. When the attack pitch control switch 16 is selectively set, an attack pitch effect is selected in which the tones are generated at a pitch slightly lower than the standard pitch corresponding to the depressed keys and then the pitch is gradually raised to the standard pitch as the time elapses. These various control signals VS, GS and AS which are formed in accordance with various conditions set by control switches 14, 15 and 16 are added by an adder 17 to a pitch control signal $PC_1$ which is set by a pitch control switch 18 and supplied from a memory device 19, and the result of addition is supplied to the multiplier 4 as a tone pitch control signal TC. The multiplier 4 operates to multiply the frequency data F supplied from the frequency data memory device 3 with the tone pitch control signal TC so as to send out modified frequency data F′ which has been modified by the tone pitch control signal TC. As a consequence, the modified frequency data F′ varies in accordance with control signals VS, GS and AS and pitch control signal $PC_1$. Accordingly, the musical tone generating system (to be described later in detail) produces musical tones imparted with a vibrato effect, those with a glide effect, those with an attack pitch effect and those having pitches deviated from the standard pitches by an amount common to all tones as is set by the constant-cent pitch control switch 18. The modified freqnency data F' is supplied to an adder 7 where it is added to a pitch control signal $PC_2$ set by a constant-Hertz pitch control switch 5 and supplied from a memory device 6 for producing a sum $(F'+PC_2)$, or a frequency data F''. Since the pitch control signal $PC_2$ is added to the frequency data F' to form another frequency data F'' the musical tone corresponding to this data F'' has a tone pitch shifted by the setting of the pitch control switch 5. In this manner, the frequency data subjected to vibrato control, glide control, attack pitch control, constant-cent-deviation pitch control, and constant-Hertz-deviation pitch control is sent to the accumulator 9 via a gate circuit 8. The accumulator 9 is provided with a cumulative adder which accumulates the frequency data F'' of respective channels and a temporary memory circuit which holds the accumulated values for the period of 12 time slots (corresponding to the maximum available number of tones which are generated simultaneously) until the next accumulation of that channel is made. The output (accumulated value q F'') of the accumulator 9 is applied to the waveshape memory device 10 for controlling the reading out operation thereof. For this reason, upper order 6 bits, for example, of the accumulator 9 are decoded (lower order bits are used for the accumulation above) to produce address signals to read the waveshape memory device 10 which stores the amplitude samples of one waveshape of a music tone by dividing the waveshape into 64 sections along a time axis. The musical tone waveshape read out from the waveshape memory device 10 is multiplied by an attack and decay envelope supplied from the envelope generator 11 and the product is then generated as a musical tone after its tone pitch and volume have been suitably controlled by the sound system 12.

When a frequency data F generated by the frequency data memory device 3 corresponding to the key data KD is controlled by the tone pitch control signal TC and the pitch control signal $PC_2$ to be converted into a modified frequency data signal F'', the frequency $f_T$ of the musical tone waveshape read out from the waveshape memory device 10 is expressed by an equation.

$$f_T = \frac{\frac{f_0}{N} \times F''}{M}$$

where M represents the modulo of the cumulative adder of the accumulator 9 and N the number of the simultaneously available tones.

Such an electronic musical instrument wherein frequency data F'' corresponding to a key data KD are sequentially accumulated by an accumulator 9, and the accumulated output is used as an address signal for reading out the waveshape of a desired musical tone stored in the waveshape memory device 10 so as to form the musical tone, is described in detail, for example, in U.S. Pat. No. 3,882,751, issued on May 13, 1975. Accordingly, the modifying value generator 13, which characterizes the invention, will be described in detail in the following.

Figure 2:
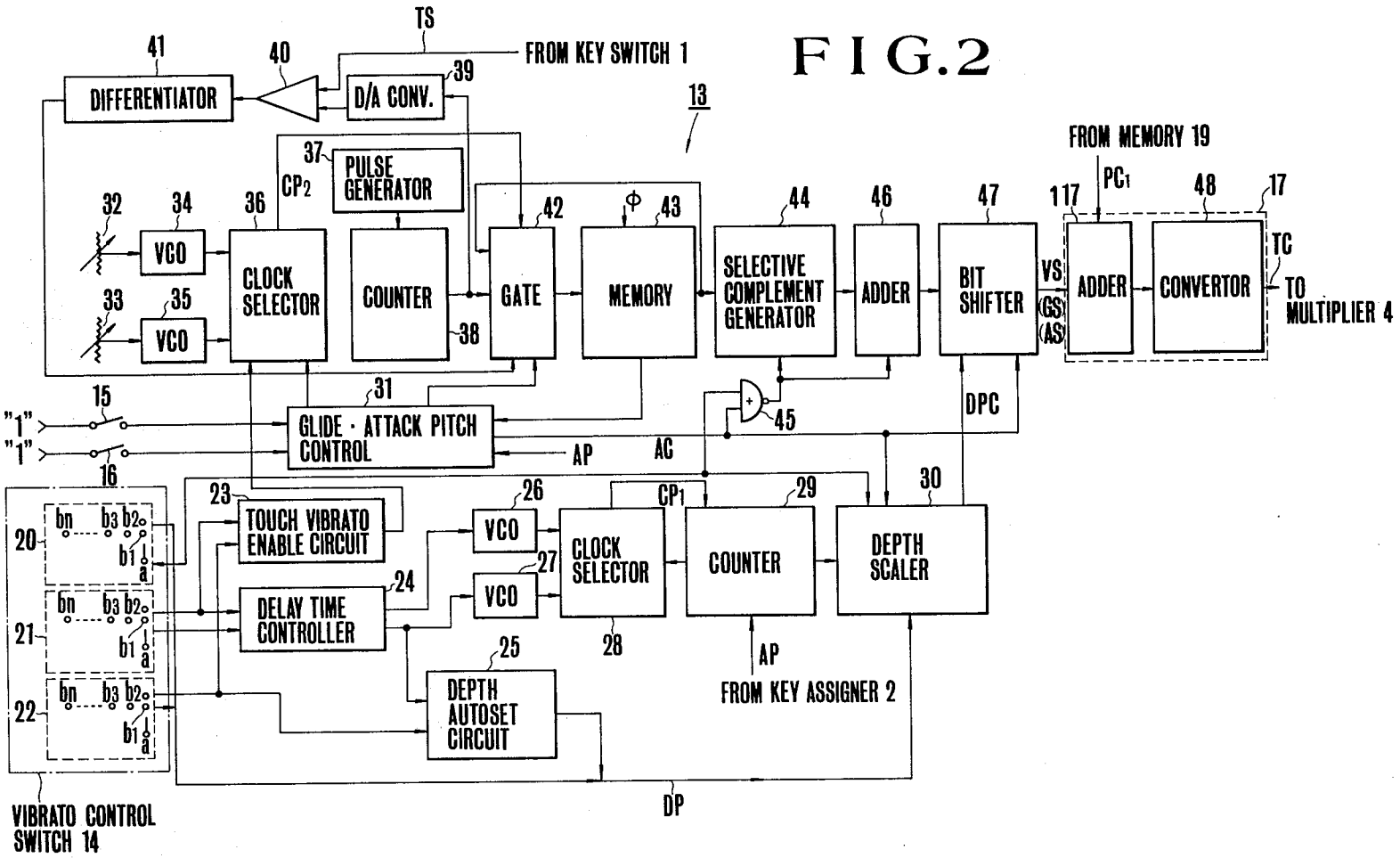
FIG. 2 is a block diagram showing one example of the modifying value generator shown in FIG. 1.
Figure 3:
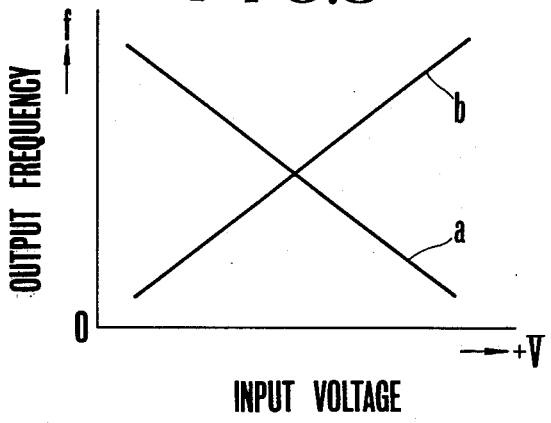
FIG. 3 is a graph showing the relationship between the input control voltage and the oscillation frequency of the voltage controlled type oscillator shown in FIG. 2.

In the block diagram of FIG. 2 showing one example of modifying value generator 13, circuit elements corresponding to those shown in FIG. 1 are designated by the same reference characters. As shown, there are provided a touch vibrato depth selection switch 20 which selects a touch vibrato and sets its depth, a delay vibrato and delay time selection switch 21 which selects a delay vibrato and sets its delay time, a vibrato depth selection switch 22 which sets the depth of the vibrato. These switches constitute a vibrato control switch 14. The touch vibrato depth selection switch 20 is provided with a movable contact a and a set of stationary contacts $b_1$ through $b_n$ which set the depths of n steps including an OFF of the touch vibrato, whereas the delay vibrato and delay time selection switch 21 is provided with a movable contact a and a set of stationary contacts $b_1$ through $b_n$ which set the delay times of n steps including an OFF of the delay vibrato. Likewise, the vibrato depth selection switch 22 is provided with a movable contact a and a set of stationary contacts $b_1$ through $b_n$ which set the depths of the n steps. There are also provided a touch vibrato enable circuit 23 which detects the OFF states of both of the delay vibrato and delay time selection switch 21 and the vibrato depth selection switch 22 (in which movable contacts a are engaging stationary contacts b respectively) for enabling a touch vibrato; a delay time controller 24 which detects the delay time selected by the delay vibrato and delay time selection switch 21 and generates a voltage signal corresponding to the detected delay time; a depth autoset circuit 25 which detects the fact that the movable contact a of the delay vibrato and delay time selection switch 21 has selected one of the stationary contacts $b_2$ through $b_n$ except the OFF contact, and that the movable contact a of the vibrato depth selection switch 22 has selected stationary contact $b_1$ allocated for the OFF state for generating a predetermined depth setting signal; a first voltage controlled oscillator (VCO) 26 which generates an extremely high frequency signal when the movable contact a of the delay vibrato and delay time selection switch 21 has selected stationary contact $b_1$ allocated to the OFF state but generates a low frequency signal when the movable contact a has selected one of the other stationary contacts $b_2$ through $b_n$; a second voltage controlled oscillator (VCO) 27 which generates a signal having a frequency reversely proportional to the output voltage of the delay time controller 24, as shown in FIG. 3; a clock selector 28 which selects the output signals produced by the first and second VCOs 26 and 27 for producing a clock pulse signal $CP_1$; a counter 29 which is reset each time it is supplied with an attack pulse AP from the key assigner 2 for sequentially counting the clock pulse $CP_1$; and a depth scaler 30 which generates a depth control signal DPC by connecting the depth setting signal DP supplied to its input terminal in accordance with the output of the counter 29. When supplied with an "1" signal from the touch vibrato enable circuit 23, the depth scaler 30 sends out the applied depth setting signal DP without conversion, but when supplied with an "1" signal from a glide attack pitch control circuit 31 to be described hereinunder, the depth scaler 30 produces a control signal DPC having a depth [1]. The glide attack pitch control circuit 31 performs the glide control in response to "1" output of the glide control switch 15 and the attack control each time an attack pulse AP is applied thereto in response to "1" output of the attack pitch control switch 16. There are also provided a variable resistor 32 for controlling the vibrato speed; a variable resistor 33 for controlling the speed of the glide attack; a third voltage controlled oscillator (VCO) 34 for generating a signal having a frequency determined by the output voltage of the variable resistor 32; a fourth voltage controlled oscillator (VCO) 35 which generates a signal having a frequency determined by the output voltage of the variable resistor 33; a clock selection circuit 36 responsive to the output of the touch vibrato enable circuit 23 and the glide attack pitch control circuit 31 for selecting the output signal of the third VCO 34 or the fourth VCO 35 to produce a clock pulse $CP_2$; a pulse generator 37; a counter 38 for sequentially counting the pulses generated by the pulse generator 37; a digital-analogue converter 39 for converting the output of the counter 38 into an analogue signal; a comparator 40 which compares the key touch signal TS which varies when the player's hands move along the keys, with the output of the digital-analogue converter 39 thereby producing an output when they coincide with each other; a differentiator 41 which differentiates the build-up portion of the output signal produced by comparator 40; a gate circuit 42 connected to receive parallel outputs of counter 38, the differentiated output of the differentiator 41, the output of the glide attack pitch control circuit 31, the clock pulse $CP_2$ of the clock selector 36, and the output of a memory device 43 comprising a shift register including memory sections of twelve 5-bit stages (the number of the simultaneously available maximum tones) for controlling the content of the memory device 43; a selective complement generator 44 which inverts the parallel outputs of the memory device 43 in accordance with the states of its two bits of the upper order; a NOR gate circuit 45 for controlling the operation of the selective complement generator 44; an adder 46 responsive to the output of the NOR gate circuit 45 for shifting the output signal value of the selective complement generator 44 by a predetermined amount; a bit shifter 47 which shifts the output value of the adder 46 corresponding to the output value of the depth scaler 30 and shifts the vibrato control signal VS, the glide control signal GS and the attack pitch control signal AS by adding thereto a predetermined value in accordance with an attack pitch signal which is produced when the glide attack pitch control circuit 31 performs an attack pitch control thereby supplying these shifted signals to an adder 117; and a converter 48 which converts the sum of the control signals VS, GS and AS produced by adder 117 and a pitch control signal $PC_1$ supplied from the memory device 19 shown in FIG. 1 into a tone pitch control signal TC which varies, a little by little, about the decimal value [1] or gradually increases from a value a predetermined value smaller than decimal [1].

The operation of the modifying value generator 13 will be described in detail with reference to the detailed connection diagrams shown in FIGS. 4A–6B.

Delay Vibrato Performance

Figure 4A:
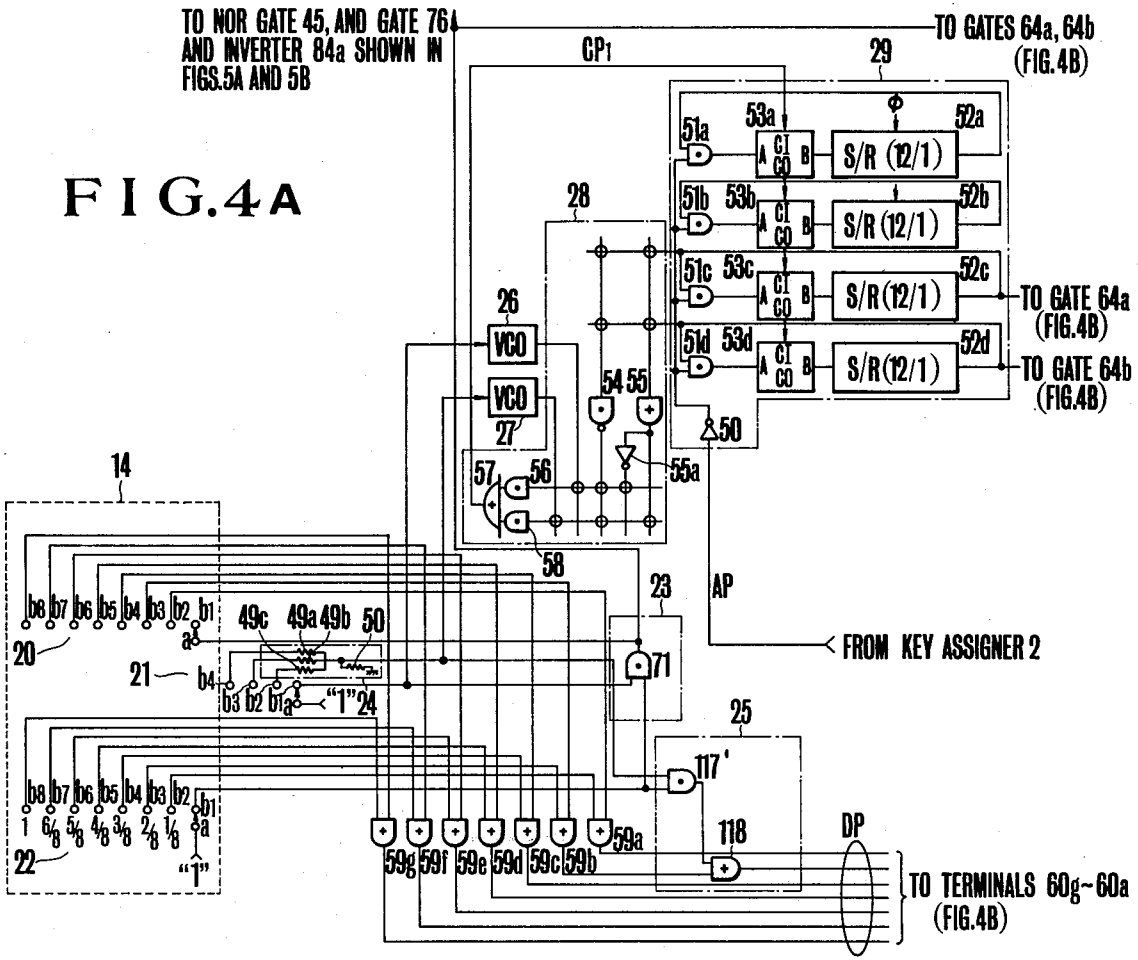
FIGS. 4A through 6B are block connection diagrams showing the detail of the modifying value generator shown in FIG. 2.
Figure 4B:
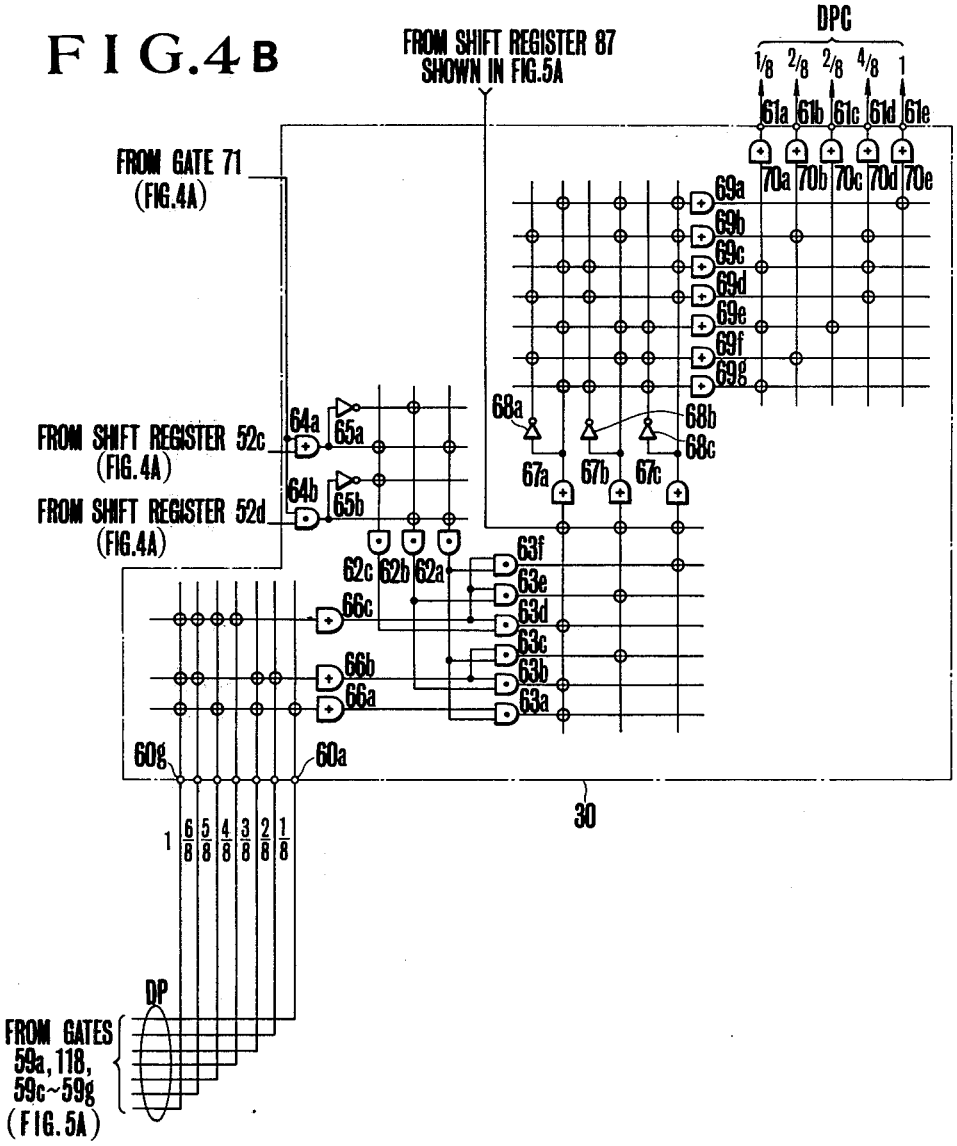

To provide a delay vibrato, the movable contact a of the delay vibrato and delay time selection switch 21 is thrown to one of the stationary contacts $b_2$ through $b_4$ except contact $b_1$ allocated to the OFF state whereas the movable contact a of the vibrato depth selection switch 22 is thrown to one of the stationary contacts $b_2$ through $b_8$ respectively allocated to [$\frac{1}{8}$], [(2/8)], [$\frac{3}{8}$], [(4/8)], [$\frac{5}{8}$], [(6/8)] and [1] of decimal values except stationary contact $b_1$ allocated to the OFF state. The stationary contacts 1, through $b_4$ of the delay vibrato and delay time selection switch 21 are respectively connected to resistors **49*a* through 49*c* which constitute the delay time controller 24, the other terminals of these resistors being grounded through a common resistor 50 as shown in FIG. 4A. These resistors have gradually increasing values, for example, 10kΩ 47kΩ and 100kΩ so as to generate fractional voltage determined by the resistors respectively connected to resistors 49*a* through 49*c*, stationary contacts $b_2$ through $b_4$ selected by the movable contact a, and the common resistor 50 as the delay time detection signals respectively corresponding to the set values of resistors 49*a* through 49*c*. Accordingly, as the movable contact a of the delay vibrato and delay time selection switch 21 is moved from stationary contact $b_2$ toward contact $b_4$ the output voltage of the delay time controller 24 increases. For example, when the movable contact a of the switch 21 is moved to the stationary contact $b_2$ the delay time controller 24 produces a signal having the lowest voltage which is applied to the voltage controlled oscillator 27 for producing a signal having a high frequency inversely proportional to the voltage signal supplied by the delay controller 24 as shown by the characteristic curve a shown in FIG. 3**.

When the movable contact a of the delay vibrato and delay time selection switch 21 is transferred to stationary contact $b_2$, the output of the stationary contact $b_1$ becomes "0" which is supplied to the voltage controlled oscillator 26 as a control input with the result that this oscillator produces a low frequency output. The input voltage-output frequency characteristic of the VCO 26 is slown by curve b in FIG. 3.

Figure 11:
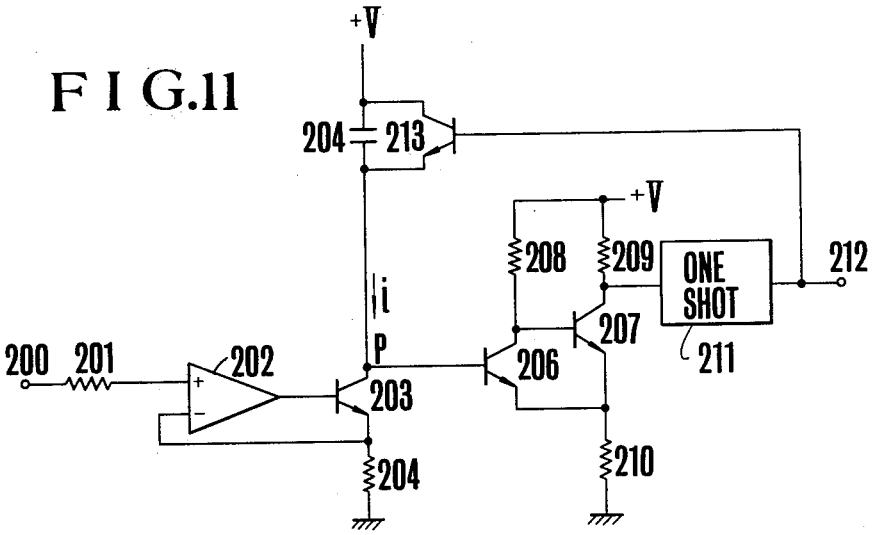
FIGS. 11 and 12 are connected diagrams showing examples of voltage controlled oscillators.
Figure 12:
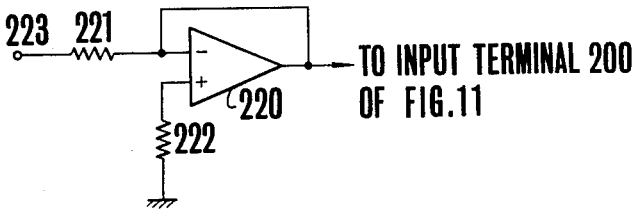

FIGS. 11 and 12 show examples of the voltage controlled oscillators 26 and 27. The VCO 26 will firstly be described with reference to FIG. 11. An input signal supplied to an input terminal 200 from the delay time countroller 24 is applied to the positive terminal of an operational amplifer 202 via resistor 201, and the output of this amplifier is applied to the base electrode of a transistor 203. The negative terminal of the operational amplifier 202 is connected to the emitter electrode of transistor 203 and to the ground through a resistor 204. The collector electrode of transistor 203 is connected to a source +V through a capacitor 205 and to the base electrode of transistor 206 which constitutes a Schmitt circuit together with transistor 207. The collector electrodes of these transistors are connected to source +V via resistors 208 and 209 respectively.

The collector electrode of transistor 207 is connected to the input of an one shot or monostable multivibrator circuit 211 for applying thereto the output of the Schmitt circuit. The output of the one shot circuit 211 is applied to an output terminal 212 and the base electrode of a transistor 213, and the collector and emitter electrodes thereof are connected to the opposite terminals of capacitor 204.

The voltage controlled amplifier having a construction as shown in FIG. 11 operates as follows. When a voltage is applied to input terminal 200, this signal is applied to the positive terminal of the operational amplifier 202 through resistor 201, and the output thereof is applied to the base electrode of transistor 203, whereby the magnitude of the collector current is determined by the magnitude of the voltage applied to the base electrode. When the transistor 203 is OFF, its collector current is zero so that the potential at point P is maintained at a value substantially equal to +V. However, when transistor 203 is turned ON, the collector current i begins to flow through capacitor 204 thus gradually charging the same. Consequently, the potential of point p decreases gradually. When this potential reaches the operation potential of the Schmitt circuit, transistor 206 becomes OFF and transistor 207 turns ON. Due to the change in the collector potential of transistor 207 which occurs when this transistor is turned ON, the one shot circuit 211 produces a pulse output which is applied to the output terminal 212 and the base electrode of transistor 213. Consequently, this transistor 213 short-circuits capacitor 204 thus discharging electric charge stored therein. The charging is repeated by the collctor current i thus producing a periodic pulse on the output terminal 212. The frequency of this pulse is determined by the magnitude of the collector current which, in turn, is determined by the magnitude of the voltage applied to imput terminal 200. Thus, when the voltage applied to the input 200 is large, the frequency of the pulse increases and vice versa.

To reverse the relationship between the input voltage and the pulse frequency, the circuit shown in FIG. 12 is connected to a preceding stage of the input terminal 200 which is constituted by operational amplier 220 and resistors 221 and 222. When this circuit is connected to the input terminal 200 the frequency of the output pulse appearing at the output terminal 212 varies in reverse proportion to the variation in the voltage applied to input terminal 223. In other words, when the input voltage is high, the frequency of the output pulse is low and vice versa. This output pulse is applied to the voltage controlled oscillator 27.

When a key of the keyboard is depressed, the key assigner 2 produces an attack pulse having a width of one time slot corresponding to the channel time assigned with a key date KD representing the depressed key. This attack pulse AP is inverted by an inverter 50 of the counter 29 (FIG. 4A) and then applied to one inputs of AND gate circuits 51*a* through 51*d* for disenabling the same. Accordingly, the shift outputs of respective shift registers 52*a* through 52*d* each having memory stages of the same number as the number of the channels simultaneously producing the tones will not be returned to the inputs of these shift registers via adders 53*a* through 53*d* with the reslt that the memory contents of the channels corresponding to the generation of the attack pulse AP is reset. As the reset stages of the shift registers 52*a* through 52*d* are sequentially shifted to produce outputs, the output signals of shift registers 52*d* and 52*c* allocated to the upper order two bits become "0" and "0". Consequently, the output of a NAND gate circuit 54 of the clock selection circuit 28 becomes "1" and the output of an inverter 55*a* which inverts the output of an OR gate circuit 55 becomes "1". Consequently, AND gate circuit 56 produces a signal "1" each time a output having a relatively low frequency is supplied from the voltage controlled oscillator 26 (that is when stationary contact $b_1$ of switch 21 is not selected) and this "1" signal is applied through an OR gate circuit 57 to a carry-in terminal CI of a half adder 53*a* allocated to the least significant bit. Consequently, the stored memory of the counter 29 of the channel portion corresponding to the channel time at which the attack pulse AP is applied is reset each time the attack pulse AP is supplied, and thereafter "1" is added to that channel each time the voltage controlled oscillator 26 generates an output signal. The count value of counter 29 corresponding to this channel increases gradually according to the frequency of oscillation of the voltage controlled oscillator 26. When the outputs of the upper two bits become "01", the outputs of the NAND gate circuit 54 and the OR gate circuit 55 of the clock selection circuit 28 become "1" respectively thereby enabling the AND gate circuit 58. consequently, this AND gate circuit 58 produces an "1" signal each time the voltage controlled oscillator 27 produces an output signal. This "1" output signal is sequentially added to the count value of the counter 29 corresponding to said channel through OR gate circuit 27.

As the count value of the counter 29 corresponding to the channel increases gradually according to the frequency of the oscillation of the voltage controlled oscillator 27, the outputs of the upper two bits become "10". In this case, however, the outputs of the NAND gate circuit 54 and the OR gate circuit 55 of the clock selection circuit 28 do not vary so that the output of the voltage controlled oscillator 27 is continuously applied to counter 29 as clock pulse $CP_1$. As the count of the counter 29 increases further due to the oscillation of the voltage controlled oscillator 27 and the output of the upper two bits become "11" the output of the NAND gate circuit 54 of the clock selection circuit 28 becomes "0" with the result that both AND gate circuits 65 and 58 are disenabled whereby the sending out of the clock pulse $CP_1$ in synchronism with the output signals of the voltage controlled oscillators 26 and 27 is interrupted.

For this reason, the counting operation of the counter 29 for the channel whose upper two bits become "11" is interrupted and the count value "11000" of the counter is held.

Summarizing the operation of the counter 29, the content of the counter which produces the upper two bits of the count is reset when an attack pulse AP is applied. When the count of the count 29 reaches "01000" by counting the number of clock pulses having a low frequency of output of the voltage controlled oscillator 26 starting from a count of "00000", the clock pulse $CP_1$ having a frequency of the output of the voltage controlled oscillator 27 is counted and when the count reaches "11000" the counting operation is stopped. The internal in which the outputs of the upper two bits of the counter 29 are "00", that is an interval between counts "00000" and "00111" in the non-vibrato time $T_1$ which is determined by the oscillation frequency of the voltage controlled oscillator 26. The interval in which the outputs of the upper two bits of the counter 29 are "01", that is the interval between counts "01000" and "01111" coresponds to the first delay time $T'_2$. In the same manner the interval in which the outputs of the upper two bits of the counter 29 are "10", that is the interval between counts "10000" and "10111" corresponds to the second delay times $T_2''$. The lengths of these delay times $T_2'$ and $T_2''$ are determined by the oscillation frequency of the voltage controlled oscillator 27 which oscillates in accordance with the value selected by the delay vibrato and delay time selection switch 21. In the same manner, the interval in which the outputs of the upper two bits of the counter 29 are "11", that is the interval in which the counting operation is stopped due to the fact that the count has reached "11000" corresponding to the normal vibrato time $T_3$ and this time is maintained until the next attack pulse AP is applied during this normal attack time $T_3$. In other words, the counter 29 sets four states of times $T_1$, $T_2'$, $T_2''$ and $T_3$ which are shown in the following Table 3.

Table 3

| Time | Count of counter 29 | Outputs of upper two bits of counter 29 |
|---|---|---|
| $T_1$ | 00000 | 00 |
| | ↓ | |
| | 00111 | |
| $T_2'$ | 01000 | 01 |
| | ↓ | |
| | 01111 | |
| $T_2''$ | 10000 | 10 |
| | ↓ | |
| | 10111 | |
| $T_3$ | 11000 | 11 |

The construction and operation of the depth scaler 30 will now be described. the depth scaler 30 (FIG. 4B) is constructed to generate a depth control signal DPC which increases gradually from zero corresponding to the output of the clock selector 28 to the depth setting signal DP which are supplied from respective stationary contacts $b_2$ through $b_8$ of the vibrato depth selection switch 22 through OR gate circuits 59*a* through 59*g*, respectively. Where weights [$\frac{1}{8}$], [(2/8)], [$\frac{3}{8}$], [(4/8)], [$\frac{5}{8}$], [(6/8)] and [1] are applied to the input terminals 60*a* through 60*g* respectively corresponding to respective stationary contacts $b_2$ through $b_8$ of the vibrato depth selection switch 22, the outputs appering at output terminals 61*a* through 61*e* vary as shown in the following Table 4 with respect to the outputs of the upper two bits of the counter 29. Weights [$\frac{1}{8}$], [(2/8)], [$\frac{3}{8}$], [(4/8)] and [1] are applied to output terminals 61*a* through 61*e* respectively.

Table 4

| input to depth scaler 30 | Output of depth scaler 30 | | | |
|---|---|---|---|---|
| | $T_1$ | $T_2'$ | $T_2''$ | $T_3$ |
| $\frac{1}{8}$ | 0 | 0 | 0 | $\frac{1}{8}$ |
| 2/8 | 0 | 0 | $\frac{1}{8}$ | 2/8 |
| $\frac{3}{8}$ | 0 | 0 | $\frac{1}{8}$ | $\frac{3}{8}$ |
| 4/8 | 0 | $\frac{1}{8}$ | 2/8 | 4/8 |
| $\frac{5}{8}$ | 0 | $\frac{1}{8}$ | 2/8 | $\frac{5}{8}$ |
| 6/8 | 0 | $\frac{1}{8}$ | $2/8 + \frac{1}{8} = \frac{3}{8}$ | 6/8 |
| 1 | 0 | $\frac{1}{8}$ | $2/8 + \frac{1}{8} = \frac{3}{8}$ | 1 |

Accordingly, when the movable contact a of the vibrato depth selection switch 22 (FIG. 4A) is connected to stationary contact $b_8$ applied with weight of the deepest value [1], an "1" signal will be supplied to the input terminal 60*g* of the depth scaler 30 (FIG. 4B) from the stationary contact $b_8$ via OR gate circuit 59*g*. Under these conditions when the outputs of the upper two bits of counter 29 become "00" during the time $T_1$ as above described, all AND gate circuits 62*a* through 62*c* are disenabled so that their outputs become "0" respectively. Consequently, AND gate circuits 63*a* through 63*f* and all disenabled so that no output is produced on the output terminals 61*a* through 61*e* of the depth controller 30. This shows that the depth control signal is [0].

During time $T_2'$ in which the outputs of the upper two bits of the counter 29 become "01" the outputs of OR gate circuits 64*b* and 64*a* become "01" and the outputs of invertes 65*a* and 65*b* become "10" so that AND gate circuit 62*c* produces an output signal "1". As a consequence, AND gate circuit 63*d* supplied with the output of the OR gate circuit 66*c* and the output of the AND gate circuit 62*c* produces an output signal "1" with the result that OR gate circuit 67*a* produces an output signal "1". Consequently the outputs of inverters 68*a*, 68*b* and 68*c* become "0111" with the result that among AND gate circuits 69*a* through 69*g* only the AND gate circuits 69*a* through 69*g* produces an output signal "1" which is applied to the output terminal 61*a* via OR gate circuit 70*a* to act as a depth control signal DPC which designates a depth of [$\frac{1}{8}$].

During the time $T_2''$ in which the outputs of the upper two bits of the counter 29 become "10", the AND gate circuit 62*b* produces an output signal "1" with the result that the outputs of both AND gate circuits 63*b* and 63*e* become "1". Consequently, the outputs of OR gate circuits 67*a* through 67*c* become "110" while at the same time the output of only the AND gate circuit 69*e* becomes "1". Accordingly, the outputs of both OR gate circuits 70*a* and 70*c* become "1" respectively to produce [$\frac{1}{8}$] and [2/8] at the output terminals 61*a* and 61*c* respectively thus producing a depth control signal added with a weight of [$\frac{1}{8}$] +[2/8]=[$\frac{3}{8}$].

During time $T_3$ in which the outputs of the upper two bits of the counter 29 become "11", the output signal of the AND gate circuit 62*a* becomes "1" while at the same time the outputs of AND gate circuits 63*a*, 63*c* and 63*f* all become "1". As a consequence, the outputs of OR gate circuits 67*a* through 67*c* become "111" and the output of only AND gate circuit 69*a* become "1". Then, the output of the OR gate circuit 70*c* becomes "1" to produce a depth control signal DPC added with a weight [1] on the output terminal 61*e*.

Consequently, the depth controller 30 reduces the depth of the vibrato to zero at time $T_1$ and gradually increases in there steps the depth of the vibrato selected by the vibrato depth selection switch 22 at times $T_2'$, $T_2''$ and $T_3$. The time $T_2'+T_2''=T_2$ in which the depth of the delay vibrato increases stepwisely is used as the delay time of the delay vibrato which is selected by the delay vibrato and delay time selection swtich 21.

At this time, since the movable contact a of this switch 21 has been transferred to stationary contact $b_2$ and since the movable contact a of the vibrato depth selection switch 22 has been transferred to stationary contact $b_8$, the output signal of AND gate circuit 71 becomes "0". Furthermore, both of the glide control switch 15 and the attack pitch control switch 16 are opened, the output signal of all AND gate circuit 72, OR gate circuits 73 and 74 and AND gate circuit 75 of the glide attack pitch controller 31 become "0". Consequently, the output of the AND gate circuit 77 which is supplied with the inverted output of the AND gate circuit 76*a* and OR gate circuit 74 supplied with the output of the AND gate circuit 71 becomes "0", with the result that the output of the NOR gate circuit 78 of the gate circuit 42 supplied with the "0" output signal of the OR gate circuit 73 and the "0" output signal of the AND gate circuit 77 becomes "1", which is supplied to the inputs of AND gate circuits 79*a* through 79*c*. At this time, AND gate circuits 80*a* through 80*c* are all disenabled the output signal "0" of the AND gate circuit 77. Since the output of the OR gate circuit 73 is also "0", AND gate circuits 79*a* through 79*c*, OR gate circuits 81*a* through 81*c*, half adders 82*a* through 82*e* and 12-stage/1-bit shift registers 83*a* through 83*e* cooperate to constitute a 12-stage/5-bit counter. Each time a carry signal $CP_2$ is applied to the carry-in terminal C1 of the adder 82*a* allocated to the least significant bit, a value 1 is added to the present count value (the values stored in shift registers 83*a* through 83*e*), and the sum is again held in these registers. As a result of this counting operation, when the count of a given channel becomes "11111", that is the full count, the count overflows and the counter begins to count again starting from count "00000". Thus, the output of this counter is a periodic function.

The count pulse $CP_2$ supplied to the half adder 82*a* of this counter will now be described with reference to FIG. 5B. Since the outputs of AND gate circuit 71 (FIG. 4A) and the OR gate circuit 74 are "0", the outputs of inverters 84*a* and 84*b* of the clock selection circuit 36 become "1" respectively, so that an AND gate circuit 85*a* produces a pulse signal which is synchronous with the output of the voltage controlled oscillator 34, and this pulse signal is applied to the carry-in terminal Cl of an adder 82*e* via an OR gate circuit 86 to act as the clock pulse $CP_2$. As a consequence, in this case, the counter described above counts the output of voltage controlled oscillator 34, and the counting speed thereof is determined by the variable resistor 32.

The parallel 5-bit output signals of shift registors 83*a* through 83*e* which vary in response to the oscillation frequency of the voltage controlled oscillator 34 between "00000" and "11111" are applied to the selective complement generator 44. In this case, the output signal of the 12-stage/1-bit shift register 87 which stores the output signals of the OR gate circuit 74 of the control circuit 31 for respective channels and the output signal of the AND gate circuit 71 (FIG. 4A) of the touch vibrato enable circuit 28 are both "0" so that the output of the NOR gate circuit 45 becomes "1".

Figure 7:
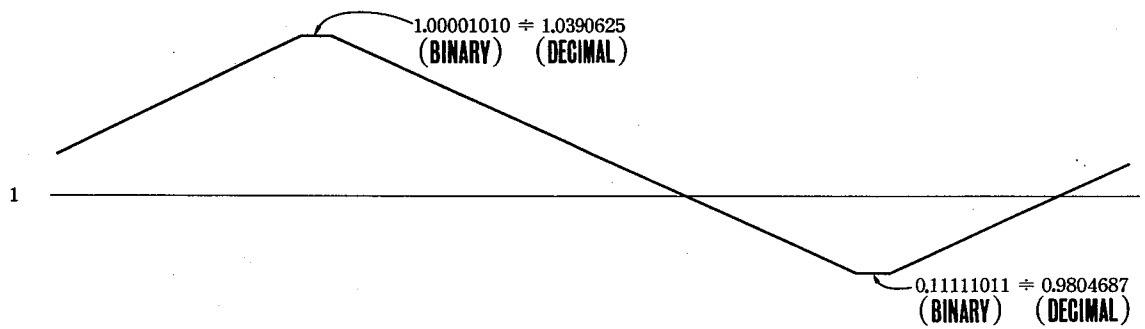
FIG. 7 is a graph showing the output values of the inverting circuit and the addition circuit shown in FIG. 2.

This "1" output signal of the NOR gate circuit 45 (FIG. 5B) is applied to one inputs of AND gate circuits 102*d* and 90 and inverter 100. Under these states, when the parallel 5-bit signals of the memory device 43 successively varies from "00000" to "11111" as shown in FIG. 7*a*, the selective complement generator 44 produces an output signal corresponding to an invention of lower 4-bit outputs in case when the outputs of the upper two bits do not conincide with each other as shown in FIG. 7*b*. In other words, when the output varies in 32 steps between counts "00000" and "11111" as shown in FIG. 7, during an interval in which the outputs of the upper two bits of the counter 29 are "00" as shown in FIG. 7*a*, that is from the first to eighth step the exclusive OR gate circuit 101 connected to receive the output signals of shift registers 83*e* and 83*d* which are allocated to the upper two digits produces an output "0". At the same time the output of the AND gate circuit 90 also becomes "0" so that all AND gate circuits 89*a* through 89*c* which are supplied with the signal "0" through inverter 103 are enabled. On the other hand, AND gate circuits 102 through 102*c* supplied with the "0" output signal of AND gate circuit 90 are disenabled. Consequently, the outputs of shift registers 83*a* through 83*c* are produced via AND gate circuits 89*a* through 89*c* and OR gate circuits 104*a* through 104*c*.

The AND gate circuit 102*d* is disenabled by the "0" output of the shift register 83*d* whereas the AND gate circuit 89*d* is disenabled by the "0" output of the inverter 100 so that the output signal of OR gate circuit 104*d* becomes "0", and the output signal of the upper second bit is equal to the "0" input signal.

Furthermore, as the most significant bit produces the output signal "0" of the shift register 83*e* as its own output, the relationship between the input and the output is always the same. Accordingly, at the first to eighth steps in which the upper two bits of the input signal are "00", the output signals of the selective complement generator 44 are the same as the input signals as shown in FIG. 7*b*.

As shown by the 9th through 16th steps in FIG. 7*a*, where the outputs of the upper two steps are "01", the output signal of the exclusive OR gate circuit 101 (FIG. 5B) becomes "1", whereby the output of the AND gate circuit 90 also becomes "1". Accordingly, only AND gate circuits 102*a*, 102*b* and 102*c* supplied with the output of AND gate circuit 90 are enabled so that the output signals of the shift registers 83*a* through 83*c* are inverted by inverters 105*a* through 105*c*. The output of the upper second bit disenables the AND gate circuits 89*d* and 102*d* in a manner as above described so that these AND gate circuits produce output signals "0", which are the inverted signals of the input signal.

As above described where the outputs of the upper two bits are "01", the outputs of the lower 4 bits are inverted and the upper two bits produce "00" as slown in FIG. 7*b*. Furthermore, as shown by the 17th through 24th steps of FIG. 7*a*, where the upper two bits produce output signals "10", the selective complement generator 44 produces an output in which the signals of the lower 4 bits are inverted as shown in FIG. 7*b* in the same manner as in the 9th through 16th steps described above. However, since the output of the shift register 83*a* is "1" and the output of the NAND gate circuit 45 is "1", the output of the upper second bit enables AND gate circuit 102*d* thus causing it to send output "1" through OR gate circuit 104*d*. The output of the shift register 83*e* is sent without any modification. Consequently, where the output signals "10" of the upper two bits are applied, as shown in FIG. 7*b*, an output is produced in which the lower four bits are inverted and the upper two bits are "11".

As shown by steps 25 through 32, when the output signals "11" of the upper two bits are applied, the exclusive OR gate circuit 101 produces an output signal "0", so that the input signal is produced as the output in the same manner as in the 1st to 8th steps. In other words the selective complement generator 44 converts an input signal which varies continuously and unidirectionally from "00000" to "11111" into an output signal which carries over one period and acts as a vibrato signal VS'.

The vibrator signal VS' formed in this manner and having a triangular shape is applied to adders 106*a* through 106*c* (FIG. 5B) which comprise an addition circuit 46 in which the output "1" of the AND gate circuit 90 is added the results of additions performed by adders 106*a* and 106*b* allocated to the lower two bits so as to effect an conversion as shown in FIG. 7*c*. This is because when a vibrato is performed the average of the musical tone pitches decreases, and in order to prevent this decimal [3] is added to raise the pitch. Adders 106*a* and 106*b* are full adders whereas adders 106*c*, 106*d* and 106*e* are half adders.

The vibrato signal VS' prepared as above described is applied to a bit shifter 47 (FIG. 6A) in which the values of the lower four bits are varied by a depth control signal DPC supplied from the depth scaler 30. More particularly, a vibrato control signal VS having a value corresponding to the depth control signal DPC is set out wherein a case in which the depth control signal is equal to "1" is taken as a reference.

Where signal "1" is applied to input terminal 107*e* of the bit shifter 47 for the purpose of making [1] the maximum depth of the delay vibrato, AND gate circuits 108*a* through 108*e* (FIG. 6A) are enabled so that all signals of the five bits of the vibrato signal VS' are applied to the B inputs of adders 110*b* through 110*e* via AND gate circuits 108*a* through 108*e* and OR gate circuits 109*c*, 109*e*, 109*g*, 109*i* and 109*k*. At this time, the A inputs of the full adders 110*b* through 110*e* are all "0", so that these adders produce the light signals as the output signals without any change. Accordingly, in this case, a vibrato signal VS' is produced as the output signal thus producing a vibrato control signal VS having a depth [1].

Where the depth scaler 30 designates a vibrato depth of [6/8], that is where a signal "1" is applied to input terminals 107*b* and 107*c*, the vibrato signal VS' multiplied by ¼ and supplied to the B input terminals of the adders 110*a* through 110*f* via AND gate circuits 114*a* through 114*f* and OR gate circuits 109*b*, 109*d*, 109*f*, 109*h*, 109*j* and 109*l* is added to the vibrato signal VS' which is multiplied by ½ and applied to B input terminals of the adders 110*a* through 110*b* via AND gate circuits 111*a* through 111*f* and OR gate circuits 109*a*, 109*c*, 109*e*, 109*g*, 109*i* and 109*k* to produce a vibrato signal VS multiplied by 6/8.

When signal "1" is applied to input terminals 107*a* and 107*d*, a vibrato signal VS' multiplied by ⅛ and produced by AND gate circuits 113*a* through 113*f* is added to a vibrato signal VS' which is multiplied by ½ and produced by AND gate circuits 111*a* through 111*f* to produce a vibrato control signal VS multiplied by ⅝.

When signal "1" is applied to input terminal 107*d*. AND gate circuits 111*a* through 111*f* produce a vibrato signal VS multiplied by 2/8.

Figure 5A:
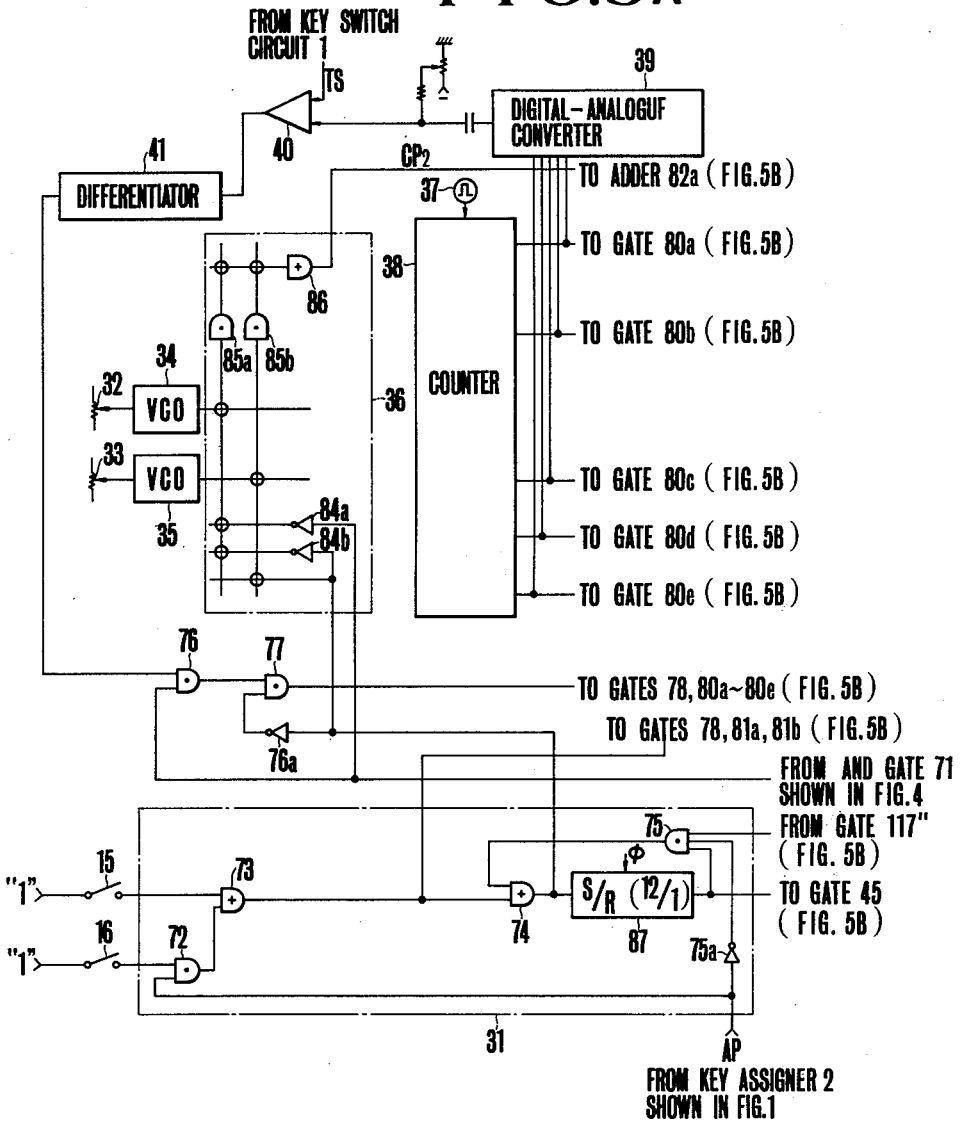

In the bit shifter 47, the most significant bit signal of the output vibrato signal VS is formed by the output of respective adders 110*a* through 110*f* and the output of an OR gate circuit 115 connected to receive the output of the upper most adder 110*f* and the output of the shift register 87 (FIG. 5A).

As above described, the vibrato control signal VS shifted by the depth control signal DPC supplied from the depth scaler 30 in added by adders 117*a* through 117*g* (FIG. 6B) to a definite cent pitch control signal $PC_1$ supplied from the memory device 19. For the purpose of varying, a little by little, the output signal of the addition circuit 17 about decimal [1] the upper bits are divided into 5 bits by a converter 48, the signal of the most significant bit is inverted by an inverter 116 into a signal representing real portion and the remaining 10 bits represent fractions. Accordingly, a vibrato control signal VS having a depth [1] as shown in FIG. 7*c* is converted by converter 48 into a signal which varies in a range between maximum value of 1.00001010 (binary)≈1.039062 (decimal) and a minimum value of 0.11111011 (binary)≈0.9804687 (decimal) FIG. 7*d* shows this vibrato control signal.

Figure 8:
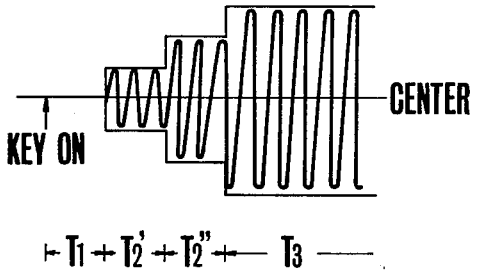
FIG. 8 is a graph showing the variation in the pitch at the time of delay vibrato performance.

The tone pitch control signal TC produced by the converter 48 is multiplied by a frequency data F supplied by the frequency data memory device 3 and corresponding to a depressed key in the multiplier (FIG. 1) to vary the tone pitch of the musical tone generated thus providing a vibrato effect. As shown in Table 4, since the depth scaler 30 gradually increases the value of the depth control signal in accordance with the count of the counter 29 the tone pitch control signal TC supplied to multiplier 4 from converter 48 also varies thus varying the tone pitch of the musical tone generated by the sound system 12 as shown by FIG. 8. More particularly, at a non-vibrato time $T_1$ no vibrato effect is provided, at delay times $T_2'$ and $T_2''$, the depth of the vibrato effect increases stepwisely, and at time $T_3$ a delay vibrato effect is provided having a depth determined by the vibrato depth selection switch 22. In this case, the delay time $T_2'+T_2''=T_2$ shown in FIG. 8 is determined by the output of the voltage controlled oscillator 27 whose oscillation frequency varies in accordance with the setting of the delay vibrato and delay time selected switch 21. Thus, the delay time can be varied as desired by the manipulation of the switch 21.

Above description relates to the delay vibrato effect under normal operation.

Misoperation of the Delay Vibrato Performance

When the movable contact a of the delay vibrato and delay time selection switch 21 is transferred to one of the stationary contacts $b_2$ through $b_4$ other than the stationary contact allocated to the OFF state for the purpose of selecting a desired delay time $T_2$ while the vibrato depth selection switch 22 is maintained in the opened state, that is while the movable contact a is thrown to the stationary contact $b_1$ thereof, no vibrato effect would be provided because in the prior art electronic musical instrument there is no means for setting vibrato depth. In the foregoing embodiment, however, since a depth autoset circuit 25 is provided for applying the output signal "1" of AND gate circuit 117' connected to receive the output of the delay time controller 24 and the output of the vibrato depth selection switch when it is thrown to stationary contact $b_1$, or OFF contact, to the depth converter 30, via OR gate circuit 118 to act as the [2/8] pitch depth setting signal DP, even when the vibrato depth selection switch 22 is misoperated at the time of providing a delay vibrato, a tone having a delay vibrato effect of a predetermined depth would be produced thus preventing the stopping of the generation of the delay vibrato tone caused by the misoperation. This greatly improves the maneuverability of the vibrato control switch 14.

Normal Vibrato Performance

To produce a normal vibrato effect tone, the movable contact a of the delay vibrato and delay time selection switch 21 is thrown to the stationary contact $b_1$ allocated to the OFF delay time, and the movable contact a of the vibrato depth selection switch 22 is thrown to one of the stationary contacts $b_2$ through $b_8$ for setting the depth of the vibrato. When the movable contact a of the delay vibrato and delay time selection switch 21 is thrown to its stationary contact $b_1$, a signal "1" is supplied to the voltage controlled oscillator 27 causing it to oscillate at an extremely high frequency.

When a key of the keyboard is depressed under these conditions, the key assigner 2 generates an attack pulse AP. When the count of the counter 29 regarding a channel corresponding to a channel time at which the attack pulse was generated, the clock selector 28 selects the high speed pulse signal generated by the voltage controlled oscillator 26 and supplies it to counter 29. As a consequence the counter 29 counts the high speed pulse and reduces the non-vibrato time to substantially zero. When the outputs of the upper two bits of the counter 29 become "01" the clock selector 28 selects the output of the voltage controlled oscillator 27 and supplies it to counter 29 in the same manner as above described. At this time, the movable contact a of the delay vibrato and delay time selection switch 21 is thrown to stationary contact $b_1$ so that the voltage of the control signal supplied to the voltage controlled oscillator 27 from the delay time controller 24 is zero. Consequently, the oscillator 27 oscillates at an extremely high frequency as shown in FIG. 3.

Accordingly, the delay times $T_2'$ and $T_2''$ of counter 29 elapse in a moment and delay time $T_3$ is reached thereby generating musical tones with vibrato effect having a depth selected by the vibrato depth selection switch 22. Consequently, almost simultaneously with the depression of a key, a normal vibrato effect tone can be produced having a depth selected by the vibrato depth selection switch 22. Thus, by using the control circuit described above it is possible to readily produce a delay vibrato and a normal vibrato with a single vibrato circuit by mere operation of the delay vibrato and delay time selection switch 21.

Touch Vibrato Performance

To produce a touch vibrato effect tone in which the tone pitch varies when the operator moves his fingers on the key board leftward and rightward, the movable contacts a of the delay vibrato and delay time selection switch 21 and of the vibrato depth selection switch 22 are thrown to their stationary contacts $b_1$ allocated to OFF state, whereas the movable contact a of the touch vibrato selection switch 20 is thrown to either one of its stationary contacts $b_2$ through $b_8$ for setting the depth of the vibrato during the touch vibrato performance. When the delay vibrato and delay time selection switch 21 and the vibrato depth selection switch 22 are set to the OFF state the output of the AND gate circuit 71 comprising the touch vibrato enable circuit 23 becomes "1". This output signal "1" is supplied to the depth scaler 30 via the selected one of the stationary contacts be through $b_8$ of the touch vibrato depth selection switch 20 to act as a depth setting signal DP. The output signal "1" of the AND gate circuit 71 is also supplied to AND gate circuit 76 (FIG. 5A).

When the operator moves his fingers on the keyboard laterally under these conditions, an analogue key touch signal TS corresponding to the movement of the fingers is supplied to comparator 40 from the key switch circuit 1. The comparator 40 compares this key touch signal TS with the output of the digital-analogue converter 39 which receives the count value of the counter 39 which counts the output of the oscillator 37 and sends out a sawtooth shaped output. The output of the comparator reverses each time when the compared two signals coincidence with each other. The build-up portion of the output signal of the comparator 40 is defferentiated by differentiator 41 to produce a differentiated pulse which is applied to gate circuit 42 via AND gate circuits 76 and 77 (FIG. 5A). In the gate circuit 42, each time a pulse is supplied from AND gate circuit 77 the output signal of the NOR gate circuit 78 in inverted to "0" to enable AND gate circuits 79*a* through 79*e* thus stopping the operation of the counter.

When the AND gate circuit 77 produces a pulse shaped output signal "1", AND gate circuits 80*a* through 80*e* (FIG. 5B) are enabled to store parallel five-bit output signals of the counter 38 in shift registers 83*a* through 83*e* which comprise the memory device 43 via AND gate circuits 80*a* through 80*e*, OR gate circuits 81*a* through 81*e* and adders 82*a* through 82*e*.

Consequently, under these condition, counter 38, digital-analogue converter 39, comparator 40, differentiator 41, AND gate circuits 76 and 77 and gate circuit 42 comprise an analogue-digital converting unit which converts the key touch signal TS supplied from the key switch circuit 1 into a corresponding 5-bit digital signal. When the output signal of the AND gate circuit 71 becomes "1" the outputs of the inverters 84*a* and 84*b* become "01" with the result that both AND gate circuits 95*a* and 85*b* are disenabled to prevent the clock selector 36 from producing an output pulse. Accordingly, adders 82*a* through 82*e* do not perform any addition operation. Consequently, the 12-stage/5-bit shift register 43 which constitutes the memory device 43 operates to sequentially store and send out parallel five-bit signals corresponding to the touch signal TS supplied from the key switch circuit 1. Thus, the memory device 43 produces a vibrato control signal VS corresponding to the touch signal TS.

In the selective complement generator 44, when the output signal of the AND gate circuit 71 (FIG. 4A) becomes "1", the output signal of the NOR gate circuit 45 becomes "0" so that the input signal is produced as the output signal without being inverted, and the addition circuit 46 produces the input signal as the output signal without performing any addition operation. Accordingly, as the time of providing a touch vibrato, the selective complement generator 44 and addition circuit 46 merely transfer the output signal of the memory circuit 43 to bit shifter 47 so that this bit shifter performs its shift operation in accordance with the depth control signal DPO supplied from the depth scaler 30. At this time, since the output signal of the AND gate circuit 71 is also supplied to the OR gate circuits 64*a* and 64*b* of the depth scaler 30 the output signal of the AND gate circuit 62*a* becomes "1" thus enabling AND gate circuits 63*a*, 63*c* and 63*f*. Accordingly, the depth scaler 30 continuously produces a depth control signal DPC which is selected by the touch vibrato selection switch 20. Consequently, the bit shifter 47 shifts the vibrato control signal VS corresponding to the key touch signal TS produced by the memory device by a depth selected by the touch vibrato depth selection switch 20 so as to control the depth of the vibrato control signal. The vibrato control signal VS whose depth has been controlled in this manner is applied to the multiplier 4 (FIG. 1) via adders 117*a* through 117*g* (FIG. 6B) and converter 48 to act as the tone pitch control signal in the same manner as above described. As a consequence, the sound system 12 produces a touch vibrato effect tone whose tone pitch and period vary in accordance with the movement of the operators fingers on the keyboard. Of course the depth of the vibrato effect tone is controlled by the touch vibrato depth selection switch 20.

Glide Performance

To provide a glide performance, the glide control switch shown in FIG. 5A is closed. Then, the output signals of the OR gate circuits 73 and 74 become "1" so that the output signal of AND gate circuit 77 which is connected to receive the output of the OR gate circuit 74 through inverter 76 becomes "0" which is used to disenable all of AND gate circuits 80*a* through 80*e* (FIG. 5B). Furthermore, the output signal of the OR gate circuit 73 become "1" and the output signal of the AND gate circuit 77 becomes "0" so that the output signal of the NOR gate circuit 78 becomes "0" thus disenabling AND gate circuits 79*a* through 79*e* (FIG. 5B) thereby preventing the outputs of the shift registers 83*a* through 83*e* from returning to the inputs thereof via adders 82*a* through 82*e*. Since the output signal of the OR gate circuit 73 becomes "1", and since the "1", signal is applied to only half adders 82*a* and 82*b* allocated to the lower two bits, a predetermined initial value is written into memory device 43 and produced therefrom.

Consequently, the gate circuit 42 continues the supply of an initial value of "00011", and a glide signal GS' corresponding to this initial value is sequentially stored in shift registers 83*a* through 83*e* and shifted thereby. Since the NOR gate circuit 45 is supplied with the output signal "1" of the shift register 87 its output signal becomes "0" and the selective complement generator 44 and the addition circuit 46 supplied with this output signal "0" supply to the bit shifter 49 the glide signal GS', that is "00011" produced by the memory circuit 43 without any modification in the same manner as above described. Since the output signal "1" of the shift register 87 is applied to the OR gate circuits 67*a* through 67*c*, the depth scaler 30 produces a depth control signal DPC representing [1]. Thus, during an interval in which the glide control switch 15 is being closed the bit shifter 47 continues to send out signal "00011" which has been set by the output signal "1" of the OR gate circuit 73 (FIG. 5A) to act as the glide control signal GS. Accordingly, the pitch of the generated tone decrease, at the same time as the closure (at time $t_1$) of the glide control switch 15 and maintains the decreased state so long as the switch is maintained closed as shown in FIG. 9.

Figure 9:
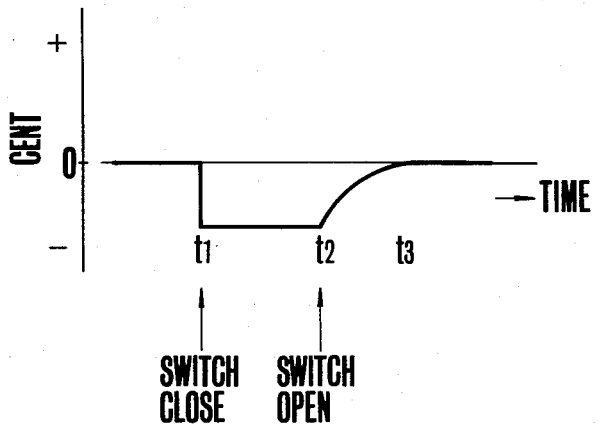
FIG. 9 is a graph showing the variation in the pitch at the time of delay vibrato performance.

When the glide control switch 15 is opened at time $t_2$ shown in FIG. 9, the output signal of the OR gate circuit 73 (FIG. 5A) becomes "0" and the output signal of the NOR gate circuit 78 (FIG. 5B) becomes "1", whereby AND gate circuits 79*a* through 79*e* are enabled. As a consequence, output signals of respective shift registers 83*a* through 83*e* are returned to the inputs thereof via adders 82*a* through 82*e* thus constituting a counter in the same manner as above described in connection with the delay vibrato. Since an initial value of "00011" is written in and shifted through the memory device 43, the output signal of the OR gate circuit 117' is "1".

Consequently, the output signal "1" of the AND gate circuit 75 which is supplied with the output signal "1" of OR gate circuit 117'', a signal "1" produced by inverting the attack clock pulse AP by inverter 75*a*, and the output signal "1" of the shift registor 87 is returned to the input side thereof via OR gate circuit 74 and maintained in the shift register. Since the output signal of the AND gate circuit 71 is "0" and the OR gate circuit 74 continuously sends out an output signal "1", the AND gate circuit 85*b* of the clock selector 36 is enabled, and the voltage controlled oscillator 35 produces a clock pulse, the frequency thereof varying dependent upon the set value of variable resistor 33. This pulse is supplied to adder 82*a* as the clock pulse $CP_2$ so that the content of respective shift registors 83*a* through 83*e* increases gradually from "00011". Accordingly, during this interval, the tone pitch of the musical tone increases gradually foward the standard (normal) tone pitch as shown by $t_2$-$t_3$ in FIG. 9, the speed of increase being determined by the oscillation frequency of the voltage controlled oscillator 35 which, in turn, is determined by the setting of the variable resistor 33. In this manner, as the count of the shift resisters 83*a* through 83*e* increases and as the output signal varies from "11111" to "00000", the output signal of the OR gate circuit 117 becomes 0 whereby the output signal of the AND gate circuit 75 becomes "0" thus clearing the memory of the shift register 87. When the output signal of the shift register 87 becomes "0" the all output signals of the OR gate circuits 67*a* through 67*c* of the depth scaler 30 become "0" whereby the depth control signal DPC supplied from the depth scaler 30 to the shifter 47 desappears thus resuming the normal tone pitch.

Above description concerns the operation wherein during the generation of musical tones, the glide control switch 15 is operated for performing a glide performance, wherein while the glide control switch 15 is maintained closed, the tone pitch of all musical tones generated is maintained below an initially set valve but gradually increases to the normal tone pitch at a speed determined by the setting of the variable resistor after the glide control switch 15 is opened. At this time, the output signal of the counter, that is the output of the memory device is a single shot function.

Attack Pitch Performance

To perform the attack pitch performance, the attack pitch control switch 16 is closed while the glide control switch 15 shown in FIG. 5A is closed. Then, the AND gate circuit 72 produces a signal "1" each time an attack pulse AP is generated. This output signal "1" is stored through OR gate circuits 73 and 74 in the channel of the shift register 89 corresponding to the channel time in which the attack pulse AP has generated.

Figure 5B:
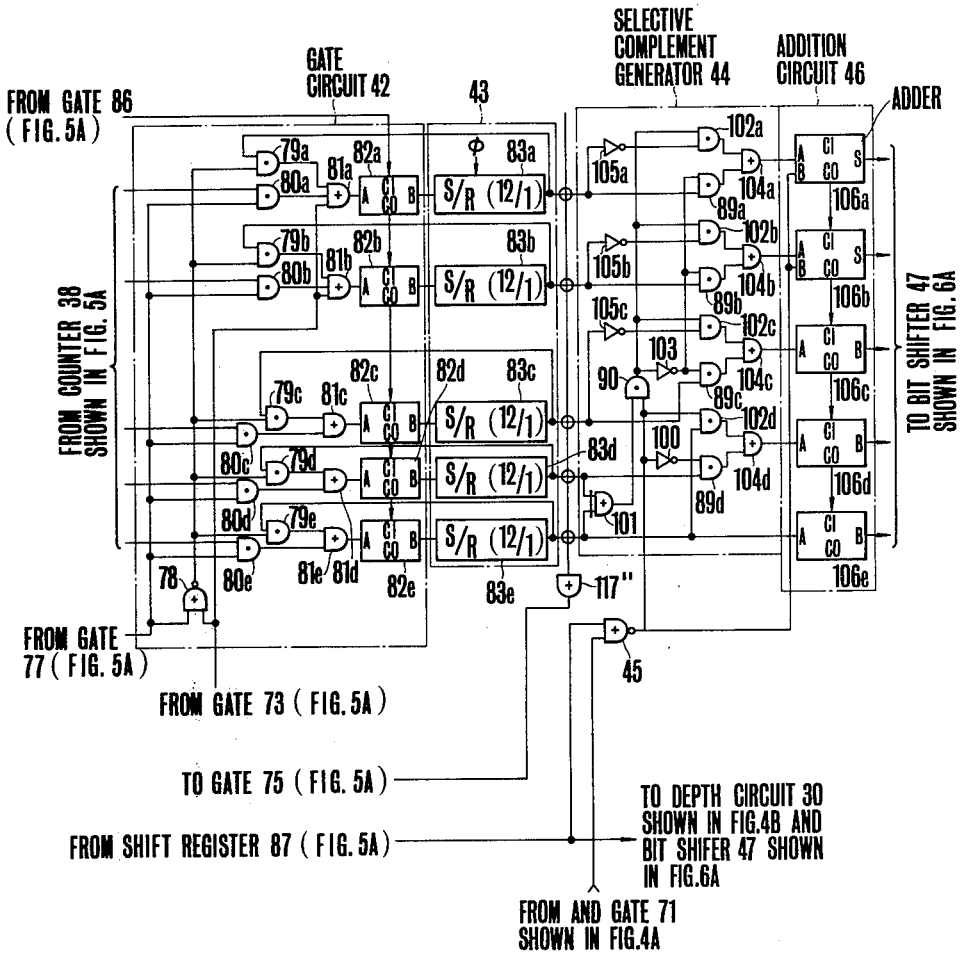
Figure 6A:
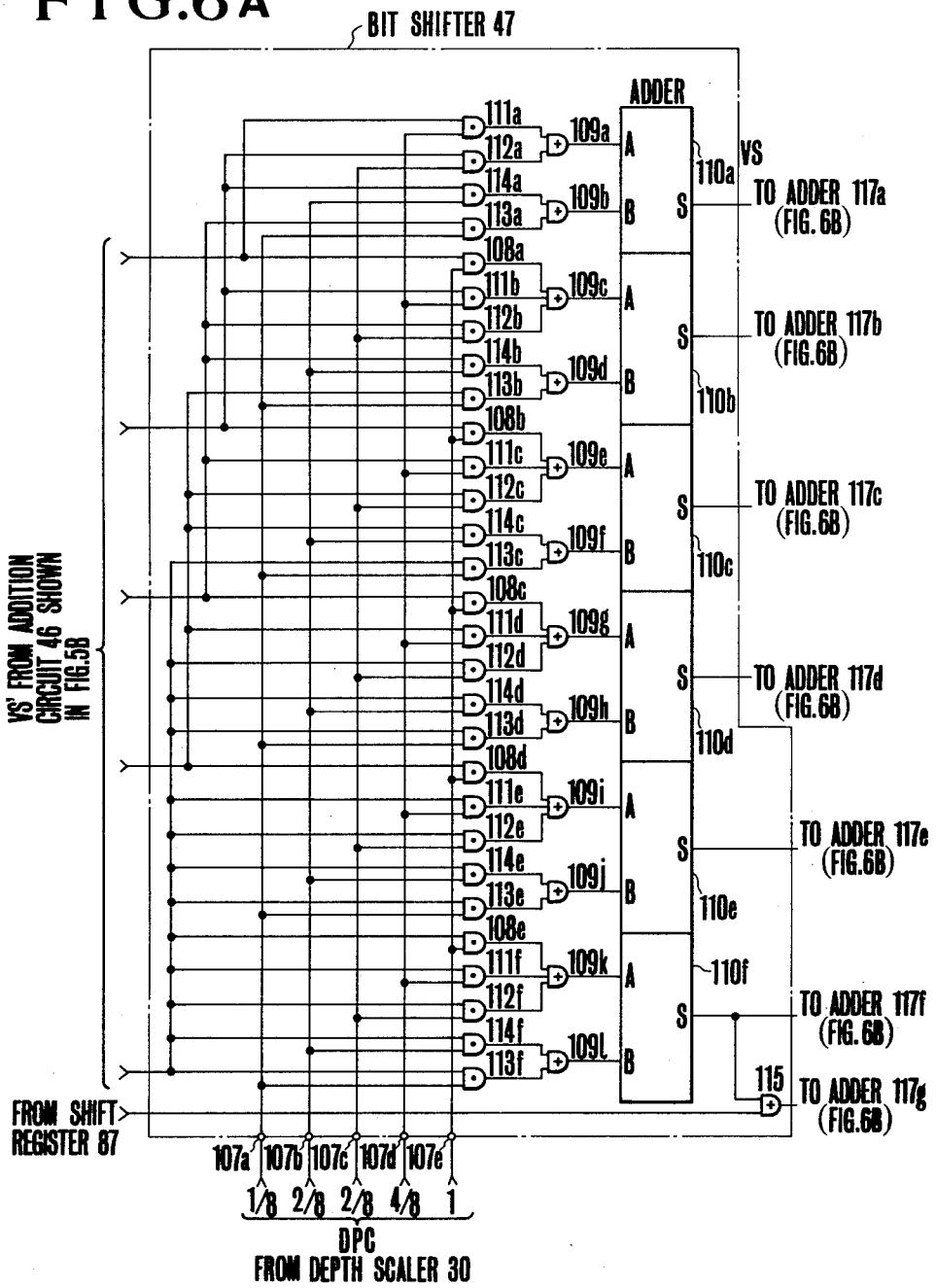
Figure 6B:
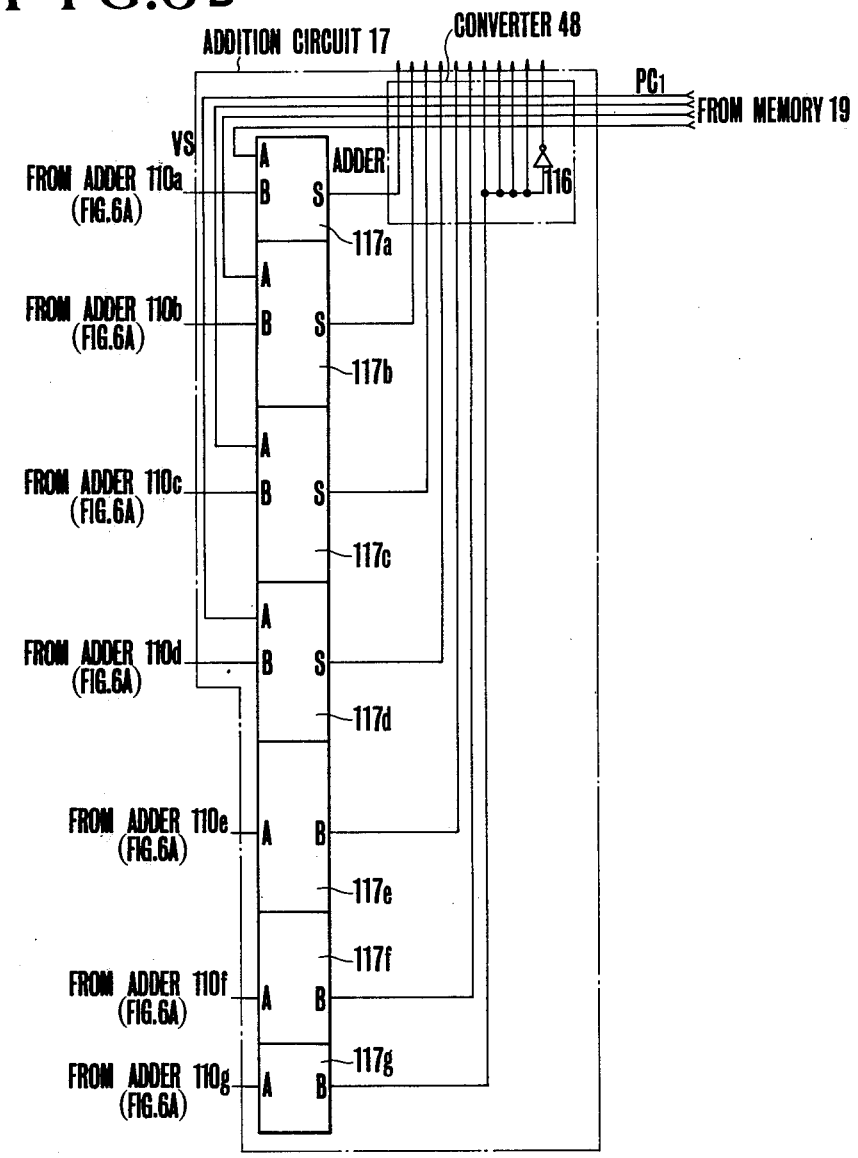

When the OR gate circuit 73 produces an output signal "1" which is synchronized with the attack pulse AP, this output signal "1" writes signal "1" in the least significant two bits of shift registers 83*a* through 83*e* via OR gate circuits 81*a* and 81*b* of the gate circuit 42 (FIG. 5B). At this time, the AND gate circuits 79*a* through 79*e* have already been disenabled by the output signal "0" of the NOR gate circuit 78, and the AND gate circuit 80*a* through 80*e* have been disenabled by the output signal "0" of the AND gate circuit 77 which is supplied with an inverted signal of the output signal "1" of the OR gate circuit 74.

With the circuit constructed as above described an initial value of "00011" is written in the stages of the shift registers 83*a* through 83*e* which correspond to the channels in which the attack pulse AP has generated so as to add the output pulse of the voltage controlled oscillator 35 thereby producing a single trigger function in the same manner as the operation during $t_2$ and $t_3$ (FIG. 9) at the time of the glide performance described above. Accordingly, the pitch of the musical tones generated at this time gradually increase to the normal tone pitch starting from the depression of the keys thus providing a tone characteristic similar to that of such musical instruments as trumpet and trombone. After the output signals of the shift registers 83*a* through 83*e* have reached "11111" as the outputs are stepped up to "00000", the output of the OR gate circuit 117'' changes from "1" to "0", whereby the memory at the stage corresponding to a given channel of the shift channel 57 is reset thus resuming the normal tone pitch.

Figure 10:
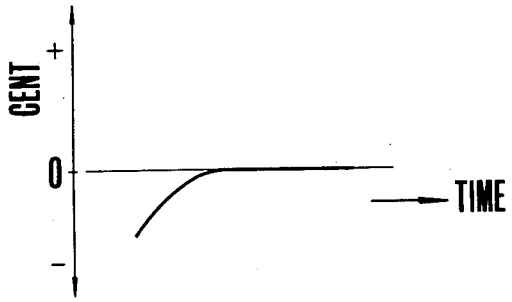
FIG. 10 is a graph showing the variation in the pitch at the time of attack pitch performance.

More particularly, when the attack pitch control switch 16 is closed, as shown in FIG. 10, an attack pitch performance effect musical tone will be generated having a lower tone pitch than the normal tone pitch is produced in response to key depression and thereafter the tone pitch increases to the normal reference tone pitch at a speed determined by the setting of the variable resistor. Above description refers to the operation of a channel allocated to an interval between $t_2$ and $t_3$ (FIG. 9) at the commencement of the glide performance.

While in the foregoing description, the delay vibrato effect and the normal vibrato effect were obtained by varying the oscillation frequencies of the voltage controlled oscillators 26 and 27 the invention is not limited to this embodiment. It should be understood that any other suitable means can be used so long as it can vary the counting speed of the generation of the vibrato control signal in accordance with the selection of the normal vibrato effect or the delay vibrato effect. For example, the same object can be accomplished by varying the ratio of frequency division of a frequency divider.

Furthermore, instead of controlling the depth of the vibrato at the time of a delay vibrato performance in three stages, the number of stages may be increased or the vibrato depth may be varied continuously.

Moreover, in the foregoing embodiment, the invention was applied to an electronic musical instrument wherein musical tone signals are produced by reading a waveshape memory device storing one period of a musical tone waveshape at a speed corresponding to the tone pitch of a depressed key, similar advantageous effects can also be obtained when the invention is applied to other electronic musical instruments utilizing different musical tone forming systems, for example a synthesizing system.

As above described the invention provides an electronic musical instrument wherein the number of signals having a predetermined frequency is counted for obtaining a delay vibrato control signal whose depth gradually increases in accordance with the variation in the counted value, and a normal vibrato control signal is formed by increasing the frequency of said signal utilized to form the delay vibrato control signal. For this reason, it is possible to selectively produce the normal vibrato control signal and the delay vibrato control signal from a single vibrato control circuit so that the circuit construction is much simpler and inexpensive than the prior art control circuit. Accordingly, the operation of the vibrato control circuit is extremely simple.

What is claimed is:

1. An electronic musical instrument conprising:

a key switch circuit designating notes to be played by key operation;

a first circuit for generating a numerical value corresponding to a frequency related to a designated not corresponding to an operated key;

a second circuit for modifying said numerical value to produce a modified signal;

a third circuit for producing a musical tone having a frequency corresponding to said modified signal;

a fourth circuit which generates a modification coefficient of said numerical value related to the designated note; and means for supplying said modification coefficient to said second circuit to modify said numerical value;

said fourth circuit including circuit means responsive to the key operation for generating a periodic signal as said modification coefficient, said circuit means having a circuit for generating said periodic signal including a portion in which the amplitude of said periodic signal increases at a predetermined rate and a succeeding portion in which the amplitude is constant, and means for varying said rate;

said rate varying means including means for providing a low rate as said predetermined rate so that the increase of said amplitude of the periodic signal takes place gradually enough to be perceived by human ears, means for providing a high rate as said predetermined rate so that said increase takes place too quickly to be perceived by human ears, and means for switching said rates.

2. An electronic musical instrument according to claim 1 wherein said periodic signal generating circuit comprises a circuit for generating a first signal having a periodicity and a definite amplitude, a circuit for producing a second signal as an output which increases at a given rate during a predetermined interval and thereafter is maintained at a definite value, and a multiplier for multiplying said first signal by said second signal.

3. An electronic musical instrument according to claim 2 wherein said second signal producing circuit comprises a pulse generating circuit for generating a pulse of a variable frequency, a counter for counting the number of said pulses and delivering a counted number as said second output signal, and means for selecting said frequency.

* * * * *

UNITED STATES PATENT AND TRADEMARK OFFICE

CERTIFICATE OF CORRECTION

PATENT NO. : 4,189,972

DATED : February 26, 1980

INVENTOR(S) : Shigeru Yamada, et al.

It is certified that error appears in the above-identified patent and that said Letters Patent are hereby corrected as shown below:

Col. 1, line 12, change "confortable" to -- comfortable --;
Col. 1, line 21, change "violines" to -- violins -- ;
Col. 2, line 31, change " connected" to -- connection -- ;
Col. 4, table 2, change "$C_5$0 11 01 01 10 01 01 00 " to -- $C_5$0 01 10 10 11 00 10 10 --;
Col. 5, line 8, change "freqnency" to -- frequency --;
Col. 6, line 12, change "contact a" to -- contact a -- ;
Col. 6, line 16, change "contact a " to -- contact a -- ;
Col. 6, line 20, change "contact a " to -- contact a --;
Col. 6, line 25, change "contact a " to -- contact a --;
Col. 6, line 33, change "contact a " to -- contact a --;
Col. 6, line 35, change "contact a " to -- contact a --;
Col. 6, line 40, change "contact a " to -- contact a --;
Col. 6, line 43, change "contact a " to -- contact a --;
Col. 7, line 60, change "Contact a " to -- contact a --;
Col. 7, line 64, change "contact a " to -- contact a --;
Col. 8, line 11, change "contact a " to -- contact a --;
Col. 8, line 14, change "contact a " to -- contact a --;
Col. 8, line 18, change "contact a " to -- contact a --;
Col. 8, line 25, change "curve a " to -- curve a --;
Col. 8, line 26, change "contact a " to -- contact a --;

UNITED STATES PATENT AND TRADEMARK OFFICE

CERTIFICATE OF CORRECTION

PATENT NO. : 4,189,972

DATED : February 26, 1980

INVENTOR(S) : Shigeru Yamada, et al.

It is certified that error appears in the above-identified patent and that said Letters Patent are hereby corrected as shown below:

Col. 8, line 34, change "slown" to -- shown --;
Col. 8, line 38, change "countroller" to -- controller --;
Col. 9, line 13, change "collctor" to -- collector -- ;
Col. 9, line 18, change "imput" to -- input -- ;
Col. 9, line 45, change "reslt" to -- result --;
Col. 10, line 6, change "consequently" to -- Consequently --;
Col. 11, line 17, change "the" to -- The --;
Col. 11, line 28, change "appering" to -- appearing --;
Col. 11, line 45, change "contact a " to -- contact a --;
Col. 11, line 63, change "invertes" to -- inverters --;
Col. 12, line 33, change "there" to -- their --;
Col. 12, line 39, change "contact a " to -- contact a --;
Col. 12, line 41, change "contact a " to -- contact a --;
Col. 13, line 38, change "invention" to -- inversion --;
Col. 14, line 20, change "slown" to -- shown --;
Col. 14, line 66, change " "1" " to -- [1] --;
Col. 15, line 8, change "light" to -- input --;
Col. 15, line 10, change "a" to -- the --;
Col. 15, line 42, change "in" to -- is -- ;
Col. 15, line 54, change " $\approx$ " to -- $\cong$ --;
Col. 15, line 55, change " $\approx$ " to -- $\cong$ --;

UNITED STATES PATENT AND TRADEMARK OFFICE

CERTIFICATE OF CORRECTION

PATENT NO. : 4,189,972

DATED : February 26, 1980

INVENTOR(S) : Shigeru Yamada, et al.

It is certified that error appears in the above-identified patent and that said Letters Patent are hereby corrected as shown below:

Col. 16, line 16, Change "contact a " to -- contact a --;
Col. 16, line 44, Change "contact a " to -- contact a --;
Col. 16, line 47, Change "contact a " to -- contact a --;
Col. 16, line 49, change "contact a " to -- contact a --;
Col. 16, line 67, change "contact a " to -- contact a --;
Col. 17, line 23, change "contacts a" to -- contacts a --;
Col. 17, line 26, change "contact a " to -- contact a --;
Col. 17, line 35, change "be" to -- $b_2$ --;
Col. 17, line 51, change "defferentiated" to -- differentiated--
Col. 17, line 56, change "in" to -- is -- ;
Col. 19, line 59, change "foward" to -- toward --;
Col. 19, line 64, change "resisters" to -- registers -- .

Signed and Sealed this

*Fourteenth* Day of *October 1980*

[SEAL]

*Attest:*

SIDNEY A. DIAMOND

*Attesting Officer*

*Commissioner of Patents and Trademarks*